United States Patent [19]

Baugh et al.

[11] Patent Number: 4,540,053

[45] Date of Patent: Sep. 10, 1985

[54] BREECH BLOCK HANGER SUPPORT WELL COMPLETION METHOD

[75] Inventors: Benton F. Baugh; Herman O. Henderson, Jr., both of Houston; John H. Fowler, Spring, all of Tex.

[73] Assignee: Smith International, Inc., Newport Beach, Calif.

[21] Appl. No.: 546,531

[22] Filed: Dec. 6, 1983

Related U.S. Application Data

[62] Division of Ser. No. 350,374, Feb. 19, 1982.

[51] Int. Cl.[3] ..... E21B 43/013

[52] U.S. Cl. ..... 166/348; 166/382

[58] Field of Search ..... 166/382, 348, 341, 344, 166/368; 285/391

[56] References Cited

U.S. PATENT DOCUMENTS

| | | | |
|---|---|---|---|
| 2,118,094 | 5/1938 | McDonough et al. | 166/15 |
| 3,287,030 | 11/1966 | Crain et al. | 166/348 X |
| 3,391,735 | 7/1968 | Schramm et al. | 166/382 X |
| 3,421,580 | 1/1969 | Fowler et al. | 106/348 X |
| 3,442,536 | 5/1969 | Fowler | 285/27 |
| 3,664,689 | 5/1972 | Hanes | 285/18 |
| 3,800,869 | 4/1974 | Herd et al. | 166/0.5 |
| 3,809,158 | 5/1974 | Bonds et al. | 166/382 X |
| 3,948,545 | 4/1976 | Bonds | 285/4 |
| 3,974,875 | 8/1976 | Herd et al. | 166/0.5 |
| 4,053,023 | 10/1977 | Herd et al. | 175/7 |

*Primary Examiner*—Stephen J. Novosad
*Assistant Examiner*—William P. Neuder
*Attorney, Agent, or Firm*—Ned L. Conley; David A. Rose; William E. Shull

[57] ABSTRACT

Method for completing an underwater well includes locating drilling apparatus at the well site, and installing conductor casing in the floor of the body of water with a wellhead, blowout preventer stack, and riser attached thereto at a point near the floor, with the riser extending upwardly to the drilling means. A drill string and standard 17½ inch drill bit is then run through the wellhead and conductor casing, and a hole is drilled for suspending 16 inch casing within the wellhead and conductor casing. A hanger-support member having a casing string attached thereto is lowered into the well until it lands in the wellhead, and it is then rotated less than 360° to connect it within the wellhead. The hanger-support member is then latched within the wellhead. A hole is then drilled for suspending another casing within the wellhead, and a casing hanger with casing string is run through the riser and into the wellhead, and the casing hanger is landed on the hanger-support member.

10 Claims, 11 Drawing Figures

BREECH BLOCK HANGER SUPPORT WELL COMPLETION METHOD

This is a division of application Ser. No. 350,374, filed on Feb. 19, 1982.

BACKGROUND OF THE INVENTION

This invention relates to subsea wellhead systems and more particularly, to methods and apparatus for supporting, holding down, and sealing casing hangers within a subsea wellhead.

Increased activity in offshore drilling and completion has caused an increase in working pressures such that it is anticipated that new wells will have a working pressure of as high as 15,000 psi. To cope with the unique problems associated with underwater drilling and completion at such increased working pressures, new subsea wheelhead systems are required. Wells having a working pressure of up to 15,000 psi are presently being drilled off the coast of Canada and in the North Sea in depths of over 300 feet. These drilling operations generally include a floating vessel having a heave compensator for a riser and drill pipe extending to the blowout preventer and wellhead located at the mud line. The blowout preventer stack is generally mounted on 20 inch pipe with the riser extending to the surface. A quick disconnect is often located on top of the blowout preventer stack. An articulation joint is used to allow for vessel movement. Two major problems arise in 15,000 psi working pressure subsea wellhead systems operating in this environment, namely, a support shoulder in the wellhead housing which will support the casing and pressure load, and a sealing means between the casing hangers and wellhead which will withstand and contain the working pressure.

In the past, prior art wellhead designs permitted adequate landing support for successive casing hangers. However, with the increase in pressure rating and the landing and supporting of multiple casing strings and tubing strings within the wellhead, a small support shoulder will not support the load. Although an obvious answer to the problem would be to merely use a support shoulder large enough to support the casing and pressure load, large support shoulders projecting into the flow bore in the wellhead housing for restricted access to the casing below the wellhead housing for drilling. In the early days of offshore drilling, $16\frac{3}{4}$ inch bore subsea wellhead systems required underreaming. At that time, most floating drilling rigs were outfitted with a $16\frac{3}{4}$ inch blowout preventer system to eliminate the two stack (20 inch and $13\frac{5}{8}$ inch) and the two riser system required up until that time. As wellhead systems moved from 5,000 psi to 10,000 psi working pressure, the $18\frac{3}{4}$ inch, 10,000 psi support shoulder was developed to carry casing and pressure loads and to provide full access into the casing below the wellhead housing.

The second major problem is the sealing means. The sealing means must be capable of withstanding and containing 15,000 psi working pressures. Available energy sources for energizing the sealing means include weight, hydraulic pressure, and torque. Each sealing means requires different amounts of energy to position and energize. Weight is the least desirable because the handling of drill collars providing the weight is difficult and time consuming on the rig floor. If hydraulic pressure is applied through the drill pipe, there is a need for wireline equipment to run and recover darts from the hydraulic-to-actuated seal energization system. If darts are not used, the handling of "wet strings" of drill pipe is very messy and unpopular with drilling crews. If the seal energization means uses the single trip casing hanger technique, the cementing fluid can cause problems in the hydraulic system used to energize the seal. Maintenance is also a problem. Although torque is the most desirable method to energize a seal, there are limitations on the amount of torque which can be transmitted from the surface due to friction losses to riser pipe, the blowout preventer stack, off location, various threads, and the drill pipe itself.

The subsea wellhead system of the present invention overcomes the deficiencies of the prior art and includes many other advantageous features. The system is simple, has less than 50 parts and is suitable for $H_2S$ service. The system has single trip capability but can still use multiple trip methods. All hangers are interchangeable with respect to the outer profile so that they can be run in lower positions. The seal elements are interchangeable and are fully energized to a pressure in excess of the anticipated wellbore pressure. Back-up seals are available. The seals are not pressure de-energized. The hangers can be run without lock downs and the seal elements will seal even if the hanger lands high.

The housing support seat supports in excess of 6,000,000 lbs. (working pressure plus casing weight or test pressure) without exceeding 150% of material yield in compression. The wellhead will pass a $17\frac{1}{2}$ inch diameter bit. The present invention does no attempt to land on two types of seats at once or on two seats at once. Further, the housing support seat is not sensitive to collecting trash during drilling or to collecting trash during the running of a $13\frac{3}{8}$ inch casing. Further, the housing support seat does not require a separate trip nor does it drag snap rings down the bore.

The hanger hold down will hold down 2,000,000 lbs. The hanger hold down is positively mechanically retracted when retrieving the casing hanger body and is compatible with single trip operations. The hanger hold down is released for retrieval of the casing hanger when the seal element is retrieved. The hanger hold down is compatible with multiple trip operations and permits the running of the hanger with or without the hold down. The sealing means will work even if the hold down is not used. The hanger hold down is reusable and has a minimum number of tolerances to stack up between hold down grooves.

The sealing means of the present invention will reliably seal an annular area of approximately $18\frac{1}{2}$ inch outside diameter by 17 inch inside diameter and provide a rubber pressure in excess of 15,000 psi (20,000 psi nominally) when the sealing means is energized and the sealing means sees a pressure from above or below of 15,000 psi. The pressure in excess of 15,000 psi is retained in the sealing means after the running tool is removed. The sealing means is additionally self-energized to hold full pressure where full loading force was not applied or where full loading force was not retained. The sealing means will not be pressure de-energized. The sealing means provides a relatively long seal area to bridge housing defects and/or trash. Further, the sealing means provides primary metal-to-metal seals and uses the metal-to-metal seals as backups to prevent high pressure extrusion of secondary elastomeric seals. The sealing means of the present invention positively retracts the metal-to-metal seals from the walls prior to retrieving the sealing means. The elastomeric seals of the sealing means are allowed to relax during retrieval of the packoff assembly and is completely retrievable. The present sealing means provides a substantial metallic link between the top and the bottom of the packing seal area to insure that the lower ring is retrievable. The design allows for single trip operations. There are no intermittent metal parts in the seal area to give irregular rubber pressures. The sealing means provides a minimum number of seal areas in parallel to minimize leak paths. The sealing means is positively attached to the packing element so that it cannot be washed off by flow during the running operations. The design also allows for multiple trip operations and is interchangeable for all casing hangers within a nominal size.

The means to load the sealing means reliably provides a force to energize the sealing means to a nominal 20,000 psi. It allows full circulation if used in a single trip. However, the loading means is compatible with either a single trip operation or multiple trip operation. Further, it is interchangeable for all casing hangers within the wellhead system. The loading means will cause the sealing means to seal even if the casing hanger is set high. Further, it does not release any significant amount of the full pressure load after actuation. The loading means does not require a remote engagement of hold down threads. Further, it has no shear pins. The loading means is reusable and does not have to remotely engage hold down threads on packing nut replacement.

The casing hanger running tool includes a connection between the running tool and casing hanger which will support in excess if 700,000 lbs. of pipe load. The running tool is able to generate an axial force in excess of 900,000 lbs. to energize the sealing means. Further, the running tool is able to tie back into the casing hanger without a left hand torque. The running tool can be run on either casing or drill pipe.

Other objects and advantages of the invention will appear from the following description.

SUMMARY OF THE INVENTION

The present invention relates to a breech block hanger support in a subsea wellhead assembly particularly useful for offshore wells having a working pressure of up to approximately 15,000 psi. The wellhead assembly includes a wellhead, the breech block hanger support, a packoff for sealing the breech block hanger support with the wellhead and another casing hanger, and one or more other casing hangers supported by the breech block hanger support.

The wellhead has a bore of 17-9/16 inches to permit the passage of a standard 17½ inch drill bit. The breech block hanger support with suspended casing is landed and connected to the wellhead for supporting one or more of the other casing hangers within the wellhead and for withstanding and containing the pressure load within the well. Breech block teeth are provided on the wellhead and the breech block hanger support to permit the hanger support to be stabbed into the wellhead and rotated less than 360° for completing the connection therebetween. The breech block teeth include six groupings of six teeth and are spaced-apart no-lead threads. Breech block slots are provided between adjacent groupings of teeth to provide a natural flow way for the passage of well fluids. The breech block hanger support includes an upper annular flange for arresting the downward movement of the breech block hanger support within the wellhead. This annular flange includes flutes aligned with the breech block slots for the passage of well fluids. The flutes are more narrow than the breech block slots to prevent the breech block hanger support from passing through the wellhead.

The upper surface of the annular flange provides a bearing surface for supporting one or more of the other casing hangers. The bearing surface of the hanger support will support the casing and tubing load in addition to a 15,000 psi working pressure. The bearing surface of the breech block teeth is greater than the bearing surface provided by the annular flange of the hanger support for the next casing hanger.

The packoff is provided for sealing the breech block hanger support with the wellhead and with the next casing hanger. The packoff includes means for testing the integrity of the seals of the packoff.

After landing, connecting, sealing, and testing the breech block hanger support, the next casing hanger with casing is landed on top of the breech block hanger support. A holddown and sealing assembly is disposed between the wellhead and the next casing hanger to holddown and seal the next casing hanger. Second and third casing hangers are subsequently run into the well one after another and those hangers are similarly sealed with the wellhead. The breech block hanger support supports the three casing hangers with suspended casing and at the same time, withstands and contains a 15,000 psi working pressure.

Another embodiment of the invention includes the extension of the body of the breech block hanger support whereby a holddown and sealing assembly may be disposed between the breech block hanger support and the wellhead. The holddown and sealing assembly includes a seal portion having a plurality of fustroconical metal links connected together by connector links to form a Z shape. The adjacent metal links form annular grooves for housing resilient elastomeric members. A tool is provided for actuating by torque and hydraulic pressure the holddown and sealing assembly to establish a primary metal-to-metal seal and a secondary elastomeric seal between the breech block hanger support and the wellhead.

BRIEF DESCRIPTION OF THE DRAWINGS

For a detailed description of the preferred embodiment of the invention, reference will now be made to the accompanying drawings wherein.

DESCRIPTION OF THE PREFERRED EMBODIMENT

The present invention is a subsea wellhead system for running, supporting, sealing, holding, and testing a casing hanger within a wellhead in an oil or gas well. Although the present invention may be used in a variety of environments, FIG. 1 is a diagrammatic illustration of a typical installation of a casing hanger and a casing string of the present invention in a wellhead disposed on the ocean floor of an offshoe well.

Figures 1, 2C:
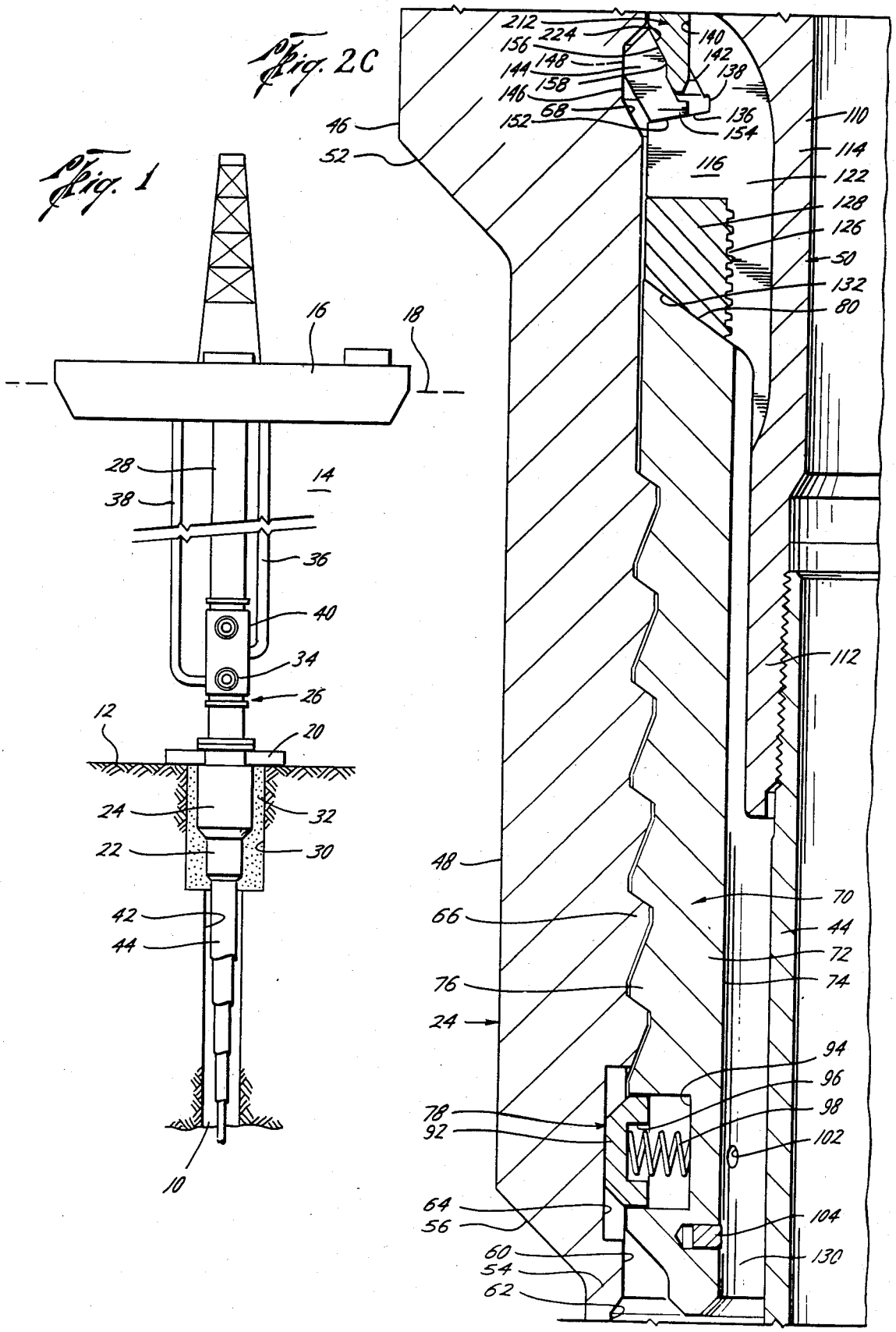
FIG. 1 is a schematic view of the environment of the present invention.
FIGS. 2A, 2B, and 2C are section views of the wellhead, hanger support ring, casing hanger running tool, pack off and hold down assembly, and a schematic of a portion of the blowout preventer for the underwater well of FIG. 1.

Referring initially to FIG. 1, there is shown a well bore 10 drilled into the sea floor 12 below a body of water 14 from a drilling vessel 16 floating at the surface 18 of the water. A base structure or guide base 20, a conductor casing 22, a wellhead 24, a blowout preventer stack 26 with pressure control equipment, and a marine riser 28 are lowered from floating drilling vessel 16 and installed into sea floor 12. Conductor casing 22 may be driven or jetted into the sea floor 12 until wellhead 24 rests near sea floor 12, or as shown in FIG. 1, a bore hole 30 may be drilled for the insertion of conductor casing 22. Guide base 20 is secured about the upper end of conductor casing 22 on sea floor 12, and conductor casing 22 is anchored within bore hole 30 by a column 32 of cement about a substantial portion of its length. Blowout preventer stack 26 is releasably connected through a suitable connection to wellhead 24 disposed on guide base 20 mounted on sea floor 12 and includes one or more blowout preventers such as blowout preventer 40. Such blowout preventers include a number of sealing pipe rams, such as pipe rams 34 on blowout preventer 40, adapted to be actuated to and from the blowout preventer housing into and from sealing engagement with a tubular member, such as drill pipe, extending through blowout preventer 40, as is well known. Marine riser pipe 28 extends from the top of blowout preventer stack 26 to floating vessel 16.

Blowout preventer stack 26 includes "choke and kill" lines 36, 38, respectively, extending to the surface 18. Choke and kill lines are used, for among other things, to test pipe rams 34 of blowout preventer 40. In testing rams 34, a test plug is run into the well through riser 28 to seal off the well at the wellhead 24. The rams 34 are activated and closed, and pressure is then applied through kill line 38 with a valve on choke line 36 closed to test pipe rams 34.

Drilling apparatus, including drill pipe with a standard 17½ inch drill bit, is lowered through riser 28 and conductor casing 22 to drill a deeper bore hole 42 in the ocean bottom for surface casing 44. A surface casing hanger 50, shown in FIG. 2C suspending surface casing 44, is lowered through conductor casing 22 until surface casing hanger 50 lands and is connected to wellhead 24 as hereinafter described. Other interior casing and tubing strings are subsequently landed and suspended in wellhead 24 as will be described later with respect to FIGS. 5A, 5B and 5C.

Referring now to FIG. 2C, wellhead 24 includes a housing 46 having a reduced diameter lower end 48 forming a downwardly facing, inwardly tapering conical shoulder 52. Reduced diameter lower end 48 has a reduced tubular portion 54 at its terminus forming another smaller downwardly facing, inwardly tapering conical shoulder 56. Conductor casing 22 is 20 inch (outside diameter) pipe and is welded to reduced tubular portion 54 on the bottom of wellhead 24. Conductor casing 22 has a thickness of ½ and a 19 inch diameter internal bore 62 to initially receive the drill string and bit to drill bore hole 42 and later to receive surface casing string 44 as shown in FIG. 1. Wellhead housing 46 includes a bore 60 having a diameter of approximately 18-11/16 inches, slightly smaller than internal bore 62 of conductor casing 22.

Disposed on the interior of wellhead bore 60 are a plurality of stop notches 64, breech block teeth 66, and four annular grooves (shown in FIG. 5B) such as groove 68, spaced along bore 60 above breech block teeth 66. Breech block teeth 66 have approximately a 17-9/16 inch internal diameter to permit the pass through of the standard 17½ inch drill bit to drill borehole 42.

Wellhead 24 includes a removable casing hanger support seat means or breech block housing seat 70 adapted for lowering into bore 60 and connecting to breech block teeth 66. Housing seat 70 includes a solid annular tubular ring 72 having a smooth interior bore 74, exterior breech block teeth 76 adapted for engagement with interior breech block teeth 66 of wellhead housing 46, an upwardly facing, downwardly tapering conical seat or support shoulder 80 for engaging surface casing hanger 50, and a key assembly 78 for locking housing seat 70 within wellhead housing 46.

Bore 74 of solid ring 72 has an internal diameter of 16.060 inches providing conical support shoulder 80 with an effective horizontal thickness of approximately 1.3 inches to support casing hanger 50. Housing seat 70 has a wall thickness great enough to prevent housing seat 70 from collapsing under a 90,000 psi vertical compressive stress. This is of concern since wellhead 24, because of its size, weight and thickness, is a rigid member as compared to housing seat 70 which is a relatively flexible member.

Figure 3:
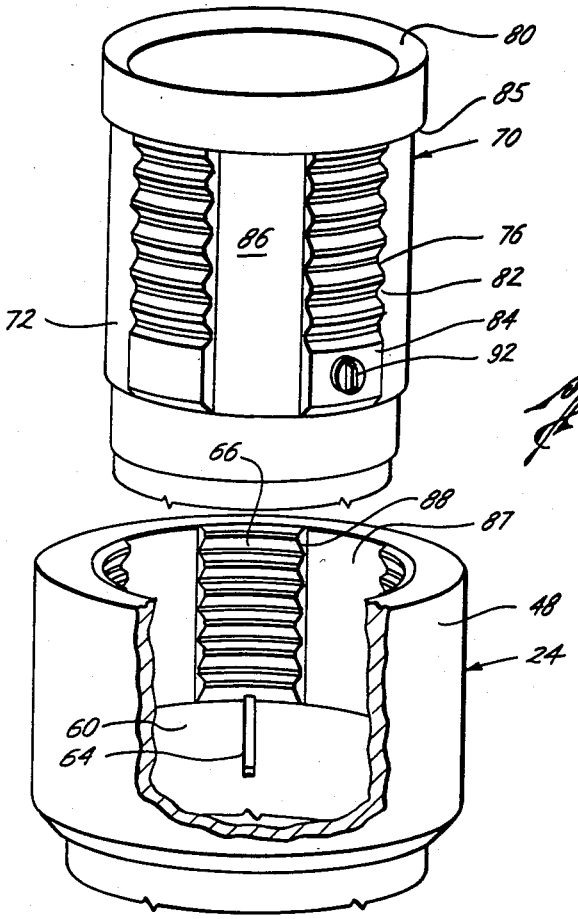
FIG. 3 is an exploded view of the breech block housing seat and a portion of the wellhead of FIG. 2.

As shown in FIG. 3, housing seat 70 includes a plurality of groupings 82 of segmented teeth 76 with breech block slots or spaces 86 therebetween for receiving corresponding groupings 88 of segmented teeth 66 in wellhead housing 46 shown in FIG. 2C. Segmented teeth 66, 76 may or may not have leads, but preferably are no-lead teeth. Teeth 66, 76 are not designed to interferingly engage upon rotation of seat 70 for connection with wellhead 24. Wellhead teeth 66 are tapered inwardly downward to facilitate the passage of the bit. If threads 66 were square shouldered or of the buttress type, they might engage the bit as it is lowered through wellhead 24 to drill bore 42 for surface casing 44. Shoulder teeth 76 have corresponding tapers to matingly engage wellhead teeth 66. Groupings 82, 88 each include six rows of segmented teeth approximately ½ inch thick from base to face. The thread area of the six rows of segmented teeth 66, 76 exceeds the shoulder area of support shoulder 80. A continuous upper annular flanges 85 on seat 70 disposed above teeth 76 limits the insertion of tooth groupings 82 into spaces 87. Continuous upper annular flange 85 prevents seat 70 from passing through wellhead 24. Lowermost tooth segment 84 is oversized to prevent a premature rotation of seat 70 within wellhead 24 until seat 70 has landed on annular flange 85.

The six rows or groupings 82, 88 of segmented teeth 66, 76 provide an even number of rows to evenly support and distribute the load. Such design evens out the stresses placed on segmented teeth 66, 76. By having six groupings of teeth, segmented teeth 66, 76 may be connected by rotating housing seat 70 30°, i.e., 180° divided by the number of groupings. Should segmented teeth 66, 76 be longer in length, a greater degree of rotation of housing seat 70 would be required for connection. It is preferable that segmented teeth 66, 76 be equal in length so that a maximum amount of contact will be available to support the loads.

Segmented teeth 66, 76 may merely be circular grooves having slots or spaces 86, 87 for connection. Segmented teeth 66, 76 have a zero lead angle and are tapered to increase the thread area so that threads 66, 76 will withstand a greater amount of shear stress. The taper of segmented teeth 66, 76 is greater than 30° and preferably is about 55° whereby the thread area is substantially increased for shear. This tooth profile attempts to equalize the stresses over all of the segmented teeth 66, 76 so that teeth 66, 76 do not yield one at a time.

Teeth 66, 76 may be of the buttress type. A square shoulder on teeth 66, 76 would catch debris and other junk flowing through the well. An added advantage of the breech block connection between wellhead 24 and housing seat 70 is that segmented teeth 76 clean segmented teeth 66 as housing seat 70 is rotated within wellhead 24. Teeth 76 knock any debris off teeth 66 so that the debris drops into the breech block slots or spaces 86, 87.

Continuous threads have several disadvantages. Threads require multiple rotations for connection and must be backed up until they drop a fraction of an inch prior to the leads of the threads making initial engagement. Further, threads ride on a point as they are rotated for connection. The breech block connection between housing seat 70 and wellhead 24 avoids these disadvantages. As housing seat 70 is lowered into wellhead 24 on an appropriate running tool, the lowermost tooth segment 84 on seat 70 will engage the uppermost tooth segment of tooth segments 66 on wellhead housing 24. Seat 70 is then rotated less than 30° to permit groupings 82 on seat 70 to be received within slot 87 between groupings 88 on wellhead 24. This drop is substantial, as much as 12 inches, and can easily be sensed at the surface to insure that housing seat 70 has engaged wellhead 24 and can be rotated into breech block engagement. Using the breech block connection of the present invention provides a clear indication when housing seat 70 is fully engaged with wellhead 24. The breech block connection of the present invention has the added advantage of permitting housing seat 70 to be stabbed into wellhead 24 and made up upon a 30° rotation of housing seat 70 to accomplish full engagement between housing seat 70 and wellhead 24.

Figure 3A:
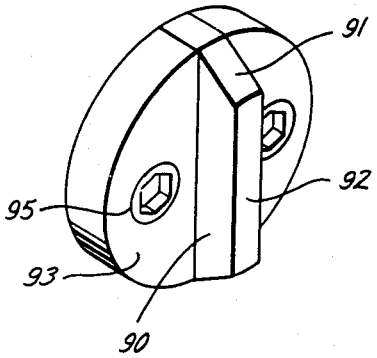
FIG. 3A is an enlarged elevation view of the key shown in FIG. 3.

Referring now to FIGS. 2C, 3 and 3A, key assembly 78 includes a plurality of outwardly biased dogs 92 each slidingly housed in an outwardly facing cavity 94 in every other lowermost tooth segment 84 of solid ring 72. Dog 92 has flat sides 90, upper and lower tapered sides 91, and a bore 96 in its inner side to receive one end of spring 98. Washers 93 are mounted by screws 95 in cavity 94 on each side of dog 92 leaving a slot for dog 92. The other end of spring 98 engages the bottom of cavity 94 to bias dog 92 outwardly. Stop notch 64 is located beneath all six groupings 88 so that dog 92 is positioned on solid ring 72 whereby dog 92 will be adjacent a stop notch 64 in wellhead housing 46 upon the complete engagement of interior and exterior teeth 66, 76 of wellhead 24 and housing seat 70. Dog 92 will be biased into notch 64 upon the rotation of ring 72 within threads 66 to thereby stop rotation of ring 72. An aperture 102 is provided through ring 72 and into cavity 94 to permit the release of dog 92.

In the prior art, the support shoulder for the surface casing hanger was integral with the wellhead housing and was large enough to support the casing and pressure load. However, this prior art integral support shoulder restricted the bore in the wellhead housing for full bore access to casing below the wellhead housing for drilling. To use a sufficiently large integral shoulder for 15,000 psi working pressures, the bore of the integral shoulder would not pass a standard 17½ inch bit. Such subsea wellhead systems required underreaming.

In the present invention, breech block housing seat 70 is an installable support shoulder which need not be installed in wellhead housing 46 until greater working pressures are encountered. Housing seat 70 is not installed until the drilling operation for surface casing 44 is complete, permitting full bore access. Since only nominal working pressures are encountered during the drilling for the surface casing 44, the larger support shoulder is not needed. After completion of the drilling for the surface casing 44, breech block housing seat 70 is installed to handle casing and pressure loads of up to 15,000 psi. Thus, sufficient clearance is provided prior to installation of housing seat 70 to pass a 17½ inch bit.

To install breech block housing seat 70, housing seat 70 is connected to a running tool (not shown) by shear pins, a portion of which are shown at 104. The running tool on a drill string then lowers housing seat 70 into bore 60 of wellhead 24 until lowermost tooth segment 84 lands on the uppermost tooth segment of tooth segments 66. Seat 70 is then rotated until teeth groupings 88 on wellhead 24 drop into breech block slots 86 and teeth groupings 82 on ring 72 are received in corresponding slots 87 on wellhead teeth 66. Continuous annual flange 85 lands on the uppermost tooth segment of segments 66 in wellhead 24. Housing seat 70 is then rotated by the drill string and running tool until keys 78 are engaged in stop notches 64 to stop rotation. A pressure test may be performed to be sure housing seat 70 is down. Then shear pins holding housing seat 70 to the running tool are sheared at 104 to release and remove the running tool.

FIG. 2C illustrates the landing of surface casing hanger 50 on breech block housing seat 70 within wellhead 24. Casing hanger 50 has a generally tubular body 110 which includes a lower threaded box 112 threadingly engaging the upper joint of casing string 44 for suspending string 44 within borehole 42, a thickened upper-section 114 having an outwardly projecting radial annular shoulder 116, and a plurality of annular grooves 120 (shown in FIG. 2B) in the inner periphery of body 110 adapted for connection with a running tool 200, hereinafter described.

Figure 2A:
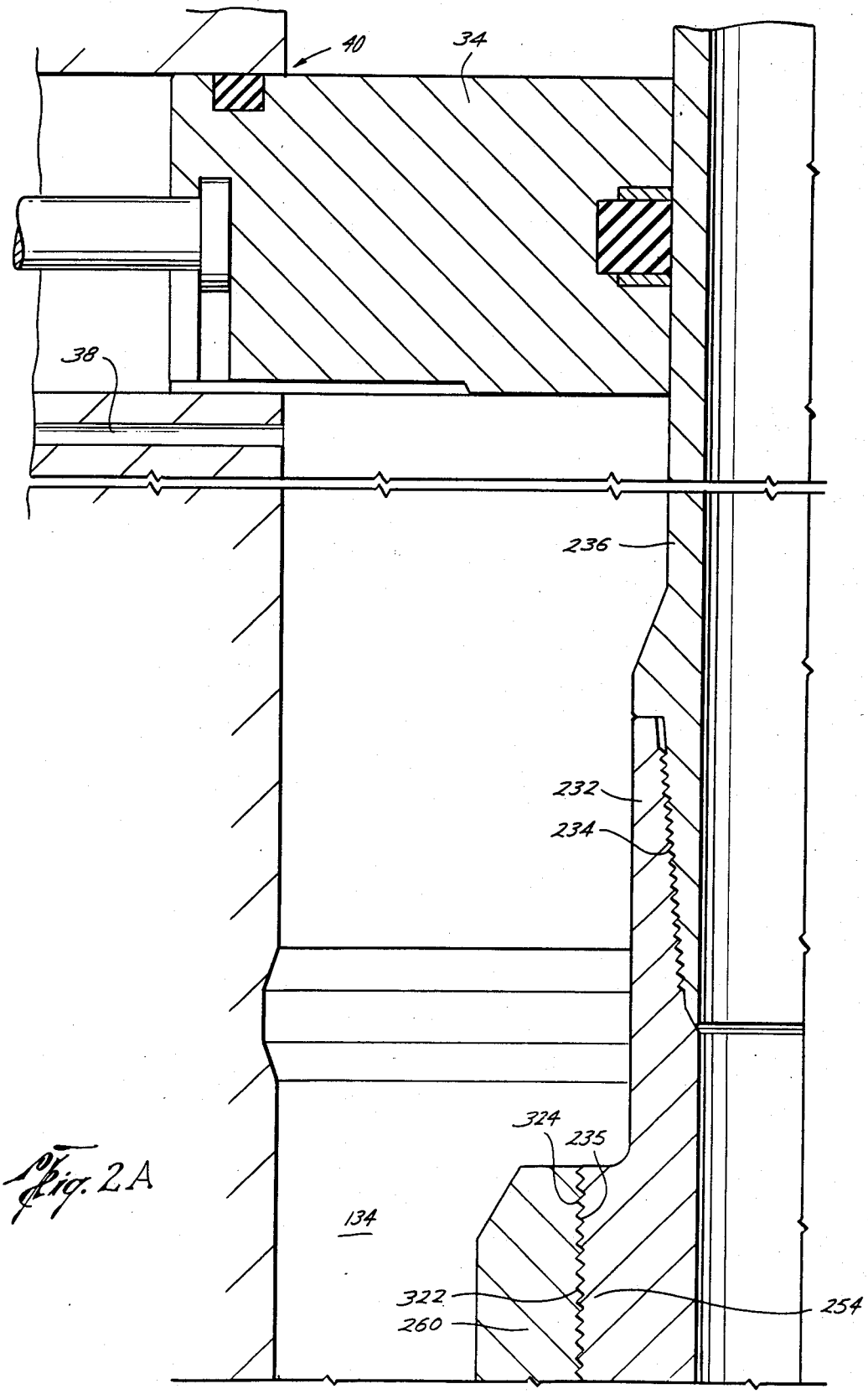
Figure 2B:
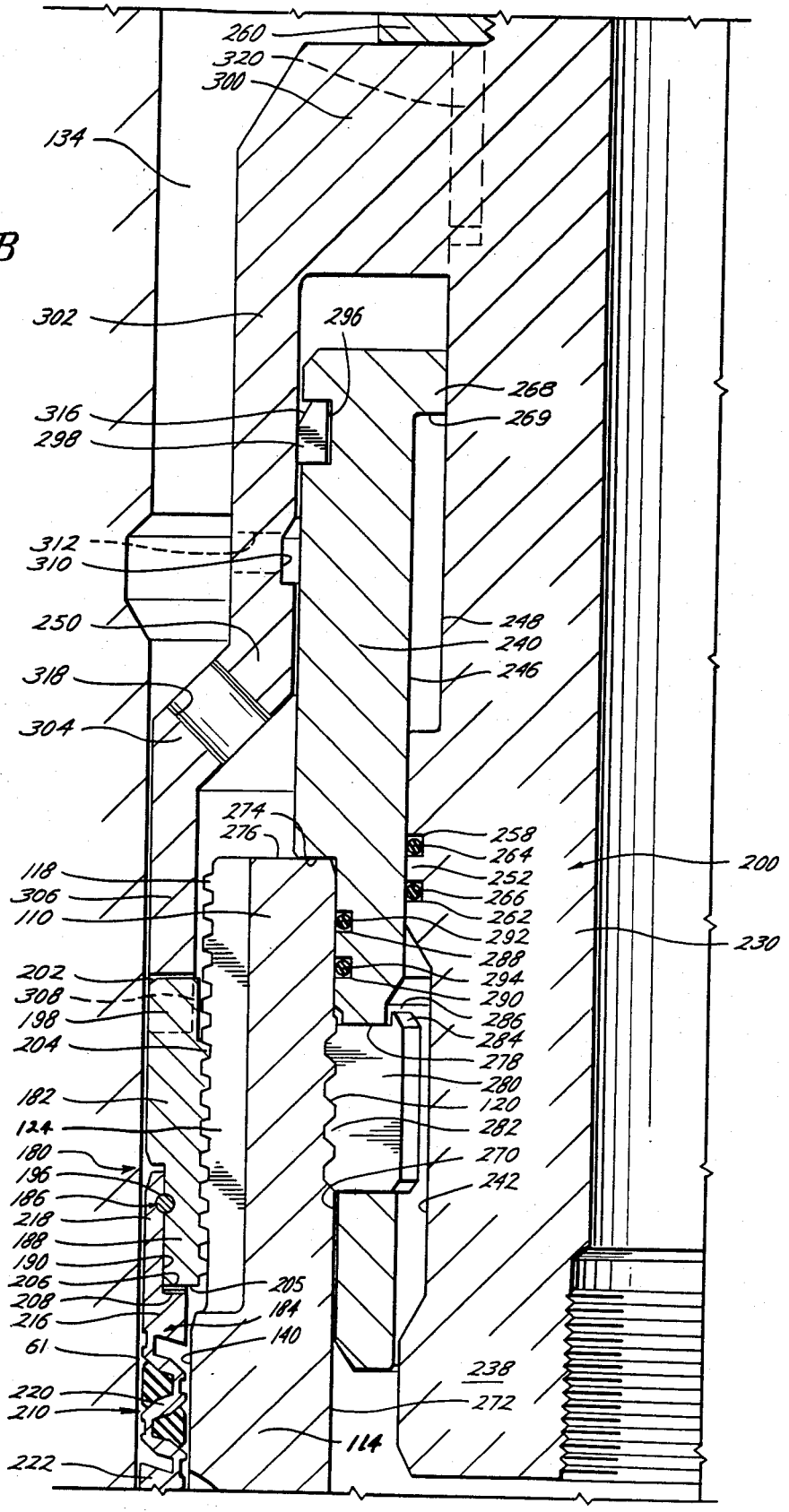

Referring now to FIGS. 2A and 2B, threads 118 are provided from the top down along a substantial length of the exterior of tubular body 110 for engagement with holddown and sealing assembly 180, hereinafter described.

The cementing operation for cementing surface casing string 44 into borehole 42 requires a passageway from lower annulus 130, between surface casing string 44 and conductor casing 22, to upper annulus 134, between wellhead 24 and the drill string 236, to flow the returns to the surface. A plurality of upper and lower flutes or circulation ports 122, 124 are provided through upper section 114 to permit fluid flow, such as for the cementing operation, around casing hanger 50. Lower flutes 122 provide fluid passageways through radial annular shoulder 116 and upper flutes 124 provide fluid passageways through the upper threaded end of tubular body 110 to pass fluids around holddown and sealing assembly 180.

Threads 126 are provided on the external periphery of upper section 114 below annular shoulder 166 to threadingly receive and engage threaded shoulder ring 128 around hanger 50. Shoulder ring 128 has a downwardly facing, upwardly tapering conical face 132 to matingly rest and engage upwardly facing, downwardly tapering conical support shoulder 80 on breech block housing seat 70. Casing hanger 50 thus lands on housing seat 70 upon engagement of conical face 132 of hanger shoulder ring 128 and housing seat support shoulder 80 whereby housing seat 70 must withstand the resulting casing and pressure load.

Wells, having a working pressure in the range of 15,000 psi, create unique loads on the wellhead supports. Not only must the wellhead support the weight of the casing hangers with their suspended casing and one or more tubing hangers with their suspended tubing, but the wellhead must withstand and contain the 15,000 psi working pressure. Thus, the wellhead must support both the casing and tubing weight and the pressure load. A 15,000 psi working pressure wellhead must have sufficient support and bearing area throughout the wellhead design such that the load does not substantially exceed the yield strength in vertical compression of the material of the wellhead supports. Although at lower working pressures materials having a 70,000 minimum yield are used, a higher strength yield material with an 85,000 minimum yield is normally used for 15,000 psi wellheads. Conservatively assuming a 90,000 vertical compressive stress on the wellhead, the wellhead of the present invention will support over 6,000,000 lbs. of load since the bearing area is in the range of 65 to 70 square inches. Such a bearing area must be consistent throughout the design so that the load does not exceed over 25% of the material yield strength in vertical compression. The bearing area between the lowermost casing hanger 50 and housing seat 70, and between housing seat 70 and supporting breech block teeth 66 on wellhead 24 must be sufficient to support such loads without substantially exceeding their material yield strength in vertical compression, i.e. over 25% of yield strength. Such a design has been achieved in the wellhead system of the present invention.

To assure sufficient bearing area between casing hanger 50 and seat 70, hanger shoulder ring 128 has been threaded onto radial annular shoulder 116 projecting from upper section 114 of casing hanger body 110. Hanger shoulder ring 128 provides a 360° conical face 132 for engaging support shoulder 80 of housing seat 70 thus providing full and complete contact between shoulder 80 and conical face 132. Without hanger shoulder ring 128, flutes or circulation ports 122 through shoulder 116 prevent a 360° bearing area between hanger 50 and housing seat 70. The engagement between support shoulder 80 and conical face 132 provides an excess bearing area determined by the wellhead internal diameter of 17-9/16 inches and the internal diameter of housing seat 70 of 16.060 inches. Thus, the bearing area between shoulder 80 and face 132 is approximately 70 square inches permitting such bearing area to support in excess of 6,000,000 lbs. in load.

Interior and exterior breech block teeth 66, 76 of wellhead 24 and housing seat 70 also have been designed to provide sufficient bearing area to support the anticipated load described above. As described previously, breech block teeth 66, 76 include six groupings 82, 88 of teeth provided on wellhead 24 and housing seat 70. Each grouping 82, 88 includes six teeth 66, 76 to support the load. The bearing area of breech block teeth 66, 76 is greater than the bearing area between shoulder 80 and conical face 132. The number of teeth is determined by the loss of bearing area due to the six spaces 86, 87 for receiving corresponding groupings 82, 88 during makeup.

Referring again to FIG. 2C, radial annular shoulder 116 projecting from upper section 114 of hanger body 110 has an upwardly facing, downwardly and outwardly tapering conical cam surface 136 with an annular relief groove 138 extending upwardly at its base. An annular chamber 142 extends from the upper side of groove 138 to an annular vertical sealing surface 140 extending from groove 138 to the lower end of threads 118. Radial annular shoulder 116 is positioned below annular lock groove 68 in wellhead housing 46 after hanger 50 is landed within wellhead 24. Cam surface 136 has its lower annular edge terminating just above the lower terminus of groove 68.

Casing hanger 50 includes a latch ring 144 disposed on radial annular shoulder 116. Latch ring 144 may be a split ring which is adapted to be expanded into wellhead groove 68 for engagement with wellhead housing 46 to hold and lock down hanger 50 within wellhead 24. Wellhead groove 68 has a base vertical wall 146 with an upwardly tapered wall and a downwardly tapered wall. Latch ring 144 has a base vertical surface 148 with a downwardly tapered surface of the extent of the upwardly tapered wall of groove 68 and an upwardly tapered surface parallel to the downwardly tapered wall of groove 68 whereby upon expansion of latch ring 144, the vertical surface 148 of ring 144 engages the vertical wall 146 of groove 68. Further, latch ring 144 includes a downwardly facing outwardly and downwardly tapering lower camming face 152 cammingly engaging upwardly facing camming surface 136 of radial annular shoulder 116, an inwardly projecting annular ridge 154 received by annular relief groove 138 in the retracted position, and an upwardly and inwardly facing camming head 156 adapted to camming engagement with holddown and sealing assembly 180, hereinafter described. Extending between camming head 156 and annular ridge 154 is tapered surface 158 parallel to the wall of chamber 142.

Projecting annular ridge 154 is received within groove 138 of casing hanger 50 to prevent latch ring 144 from being pulled out of groove 138 as casing hanger 50 is run into the well. It is necessary during the lowering of casing hanger 50 that latch ring 144 pass several narrow diameters such as in blowout preventer 40. Blowout preventer 40 often includes a rubber doughnut-type seal which does not fully retract thereby requiring casing hanger 50 to press through that rubber seal. If annular ridge 154 was not housed in groove 138, latch ring 144 might catch at such a narrow diameter and drag along the exterior surface. This might draw latch ring 144 from groove 138 and permit it to slide upwardly around casing hanger 50 until latch ring 144 engages seal means 210. This would not only prevent the actuation of holddown actuator means 212, but would also prevent the actuation of sealing means 210. Annular chamber 142 provides clearance so that groove 138 can receive annular ridge 154. This profile also provides a step which keeps latch ring 144 from having such an upward load as the load is placed on latch ring 144.

Holddown assembly and sealing 180 is shown in FIGS. 2B and 2C, engaged with running tool 200 and actuated in the holddown position. Holddown and sealing assembly 180 includes a stationary member 184 rotatably mounted on a rotating member or packing nut 182 by retainer means 186. Packing nut 182 has a ring-like body with a lower pin 188 and a castelated upper end 198 with upwardly projecting stops 202. The inner diameter surface of nut 182 includes threads 204 threadingly engaging the external threads 118 of casing hanger body 110.

Stationary member 184 has a ring-like body 216 and includes a seal means 210 for sealing between the internal bore wall 61 of wellhead 24 and external sealing surface 140 of casing hanger 50, and a holddown actuator means 212 for actuating latch ring 144 into holddown engagement within groove 68 of wellhead 24. Ring-like body 216 is a continuous and integral metal member and includes an upper drive portion 218, an intermediate Z portion 220, and a lower cam portion 222.

Upper drive portion 218 includes an upper counterbore 190 that rotatably receives lower pin 188 of packing nut 182. Retainer means 186 includes inner and outer races in counterbore 190 and pin 188 housing retainer roller cones or balls 196. Retainer means 186 does no carry any load and is not used for transmitting torque or thrust from packing nut 182 to stationary member 184. Bearing means 205 is provided above sealing means 210 and includes bearing rings 206, 208 disposed between the bottom of counterbore 190 and the lower terminal end of pin 188. Bearing rings 206, 208 have a low coefficient of friction to permit sliding engagement therebetween upon the actuation of holddown actuator means 212 and sealing means 210. Thus, bearing means 205 is utilized to transmit thrust from packing nut 182 to stationary member 184. Retainer balls 196 merely rotatively retain stationary member 184 on packing nut 182.

Holddown actuator means 212 includes lower cam portion 222 having a downwardly and outwardly facing cam surface 224 (shown in FIG. 2A) adapted for camming engagement with camming head 156 of latch ring 144, and upper drive portion 218 and intermediate Z portion 220 for transmission of thrust from packing nut 182 to lower cam portion 222.

Sealing means 210 includes Z portion 220 and elastomeric back-up seals 330, 332 which will be described in detail with respect to FIG. 4 hereinafter, and upper drive portion 218 and lower cam portion 222 for compressing intermediate Z portion 220. Sealing means 210 is a combination primary metal-to-metal seal and secondary elastomeric seal. Having a metal-to-metal seal be the primary seal has the advantage that it will not tend to deteriorate as does an elastomeric seal.

Holddown and sealing assembly 180 is lowered into the well on casing hanger 50 by a running tool 200. Running to tool 200 includes a mandrel 230, which is the main body of tool 200, a connector body or sleeve 240, a skirt or outer sleeve 250, and an assembly nut 260. Mandrel 230 includes an upper pin end 232 with internal threads 234 for connection with the lowermost pipe section of drill pipe 236 extending to the surface 18 and a lower box end 238 also having internal threads. Above box end 238 is located an annular reduced diameter groove portion 242. Another reduced diameter portion 248 is disposed above groove portion 242 forming an annular ridge 252. Below upper pin end 232 and above reduced diameter portion 248 is a third threaded reduced diameter portion 254 (shown in FIG. 2A) having a diameter smaller than that of portions 242 and 248.

Connector body or sleeve 240 includes a bore 246 dimensioned to be telescopically received over annular ridge 252 and box end 238. Connector body 240 is telescopingly received in the annulus formed by mandrel 230 and skirt 250. Ridge 252 includes annular seal grooves 258, 262 housing O-rings 264, 266, respectively, for sealing engagement with the inner diameter surface of bore 246. The top end of connector body 240 includes an internally directed radial annular flange 268 having a sliding fit with the surface of reduced diameter portion 248. The lower end of connector body 240 has a reduced diameter portion 270 which is sized to be slidingly received by bore 272 of casing hanger 50. Reduced diameter portion 270 forms downwardly facing annular shoulder 274 which engages the upper terminal end 276 of casing hanger 50 upon landing running tool 200, holddown and sealing assembly 180 on casing hanger 50 within wellhead 24. Reduced diameter portion 270 has a plurality of circumferentially spaced slots or windows 278 which slidingly house segments or dogs 280 having a plurality of teeth 282 adapted to be received by grooves 120 of casing hanger 50 for connection of running tool 200 with casing hanger 50. Dogs 280 have an upper projection 284 received within an annular groove 286 around the upper inner periphery of windows 278. Above windows 278 are a plurality of seal grooves 288, 290 housing O-rings 292, 294 for sealingly engaging the seal bore 272 of casing hanger 50. Adjacent to the upper exterior end of connector body 240 is a snap ring groove 296 housing snap ring 298 used in the assembly of running tool 200 as hereinafter described. Dogs 280 collapse back into groove portion 242 after lower box end 238 is moved to the lower position, as shown, upon the application of torque on tool 200 to set holddown and sealing assembly 180.

Skirt or outer sleeve 250 includes a generally tubular body having an upper inwardly directed radial portion 300, a medial portion 302, a transition portion 304, and a lower actuator portion 306. Portions 300, 302, 304 and 306 are contiguous and have dimensions to telescopically receive the upper terminal end 276 of casing hanger 50, connector body 240 and mandrel 230. Lower actuator portion 306 has a castilated lower end 308 engaging the upper castilated end 198 of packing nut 182 whereby torque may be transmitted from running tool 200 to holddown and sealing assembly 180. The inner diameter of actuator portion 306 is sufficiently large to clear the outside diameter of threads 118 of casing hanger 50.

Medial portion 302 slidingly receives connector body 240. Portion 302 includes an internal annular groove 310 adapted to receive snap ring 298 mounted on connector body 240 upon disengagement of running tool 200 from holddown and sealing assembly 180 and casing hanger 50, as hereinafter described. Portion 302 has a plurality of threaded bores 312 extending from its outer periphery to groove 310 whereby bolts (not shown) may be threaded into groove 310 to prevent snap ring 298 from engaging groove 310 during the resetting of running tool 200 on another casing hanger. Snap ring 298 has an upper cam surface 316 for engaging the ends of the bolts. Once connector body 240 is received into the upper portion of the annular area formed by outer sleeve 250 and mandrel 230 whereby snap ring 298 is above annular groove 310, connector body 240 cannot be removed without snap ring 298 engaging groove 310. Thus, to remove connector body 240 upon the resetting of running tool 200, bolts are threaded into bores 312 to close groove 310 and prevent grooves 310 from receiving and engaging snap ring 298. This permits connector body 240 to move downwardly on mandrel 230 until shoulder 269 engages projection 252 for connection to another casing hanger.

Transition portion 304 adjoins actuator portion 306 and medial portion 302 to compensate for the change in diameters. Flow ports 318 are provided in transition portion 304 to permit cement returns to pass through outer sleeve 250 and into annulus 134.

The upper radial portion 300 has its interior annular surface castelated to form a splined connection 320 with mandrel 230 for the transmission of torque.

Referring now to FIGS. 2A and 2B, assembly nut 260 has internal threads 324 for a threaded connection at 322 with threads 235 of reduced diameter portion 254 of mandrel 230. The lower terminal face of assembly nut 260 bears against the upper terminal end of outer sleeve 250 to retain outer sleeve 250 on mandrel 230.

In operation, the packing nut 182 is only partially threaded to threads 118 at the top of casing hanger 50 so that mandrel 230 is mounted in the running position on casing hanger 50. In the running position, annular ridge 252 abuts shoulder 269 formed by radial annular flange 268 on connector body 240. The outer tubular surface of box end 238 is adjacent to and in engagement with the internal side of dogs 280 whereby teeth 282 are biased into grooves 120 of casing hanger 50 preventing the disengagement of running tool 200 and casing hanger 50 as they are lowered into the well on drill pipe 236. The running position of running tool 200 is not illustrated in the figures.

Upon landing face 132 of shoulder ring 128 of casing hanger 50 on support shoulder 80 of housing seat 70 in wellhead 24, surface casing 44 is cemented into place within borehole 42. After the cementing operation is completed, running tool 200 is rotated and torque is transmitted to holddown and sealing assembly 180 to actuate holddown and sealing assembly 180 into the holddown position shown in FIGS. 2B and 2C. Rotation of drill pipe 236 at the surface 18 causes mandrel 230 to rotate which rotates outer sleeve 250 by means of splined connection 320. The torque from outer sleeve 250 is then transmitted to packing nut 182 at the castelated connection of stops 202 of nut 182 and lower end 308 of sleeve 250. Packing nut 182 places an axial load on holddown and sealing assembly 180 causing cam portion 222 of holddown actuator means 212 to move into camming engagement with camming head 156 of latch ring 144. Such camming expands latch ring 144 into wellhead groove 68 for engagement with wellhead housing 46 to hold and lock down casing hanger 50 within wellhead 24 as shown in FIG. 2. Sealing means 210 has not yet been actuated to seal between upper annulus 134 and lower annulus 130. Latch ring 144 requires only a predetermined camming load for actuation and therefore has a predetermined contractual tension. Sealing means 210 is designed in cross section to insure that sealing means 210 will not be prematurely compressed upon the actuation and camming of latch ring 144 by holddown actuator means 212. The load required to compress sealing means 210 is substantially greater than that required to expand and actuate latch ring 144. Mandrel 230 moves downwardly with skirt 250 upon the actuation of holddown and sealing assembly 180. This downward movement of mandrel 230 releases dogs 280.

Figure 4:
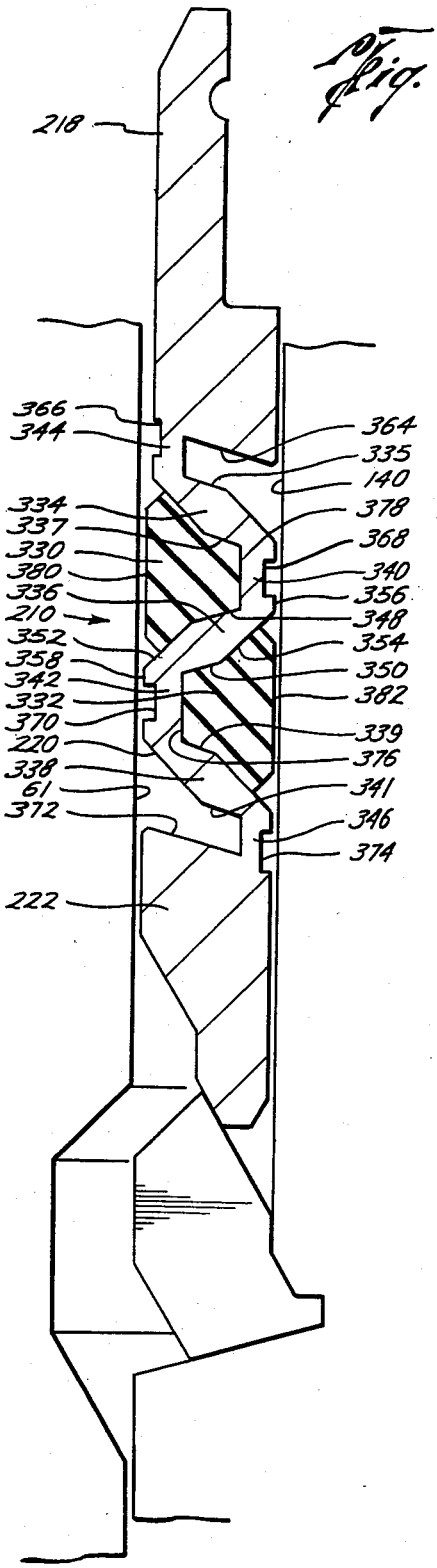
FIG. 4 is a section view of the sealing element in the running position and FIG. 4A is a section view of the sealing element in the sealing position.
Figure 4A:
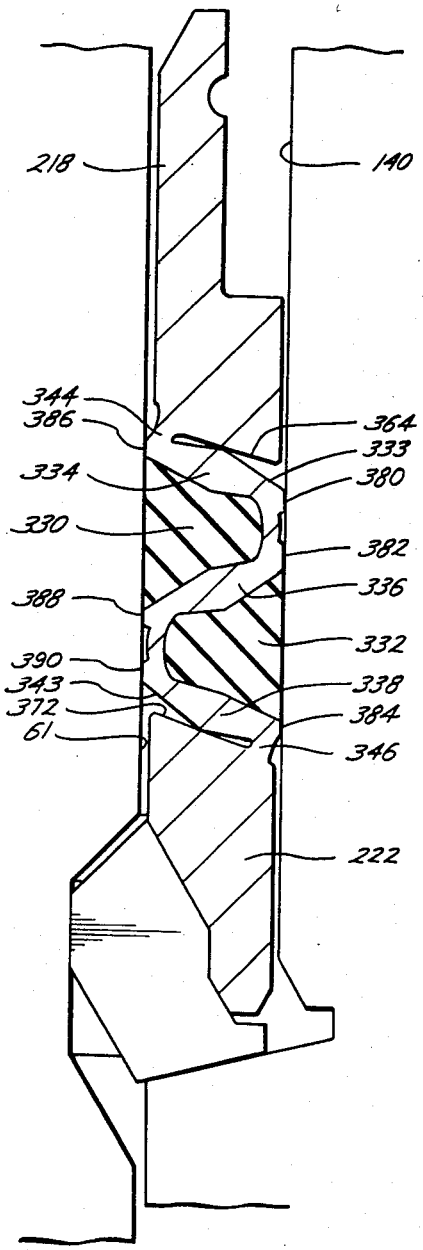

For a description of sealing means 210, reference will now be made to FIGS. 4 and 4A showing sealing means 210 in the running and holddown positions and the sealing position, respectively. Sealing means 210 includes metal Z portion 220, upper and lower elastomeric members 330, 332, respectively, and upper drive portion 218 and lower cam portion 222 for compressing Z portion 220 and elastomeric members 330, 332. Metal annular Z portion 220 includes a plurality of annular links 334, 336, 338 connected together by annular metal connector rings 340, 342 and connected to upper drive portion 218 by upper metal connector ring 344 and to lower cam portion 222 by lower metal connector ring 346.

Links 334, 336, 338, together with connector rings 340, 342, 344, and 346, provide a positive connective link from bottom to top between lower cam portion 222 and upper drive portion 218. This positive connective link causes links 334, 336, and 338 to move into a more angled disengaged position from wellhead 24 and casing hanger 50 upon the retrieval and disengagement of sealing means 210 and actuator means 212 from wellhead 24. Further this positive connective link provides a metal connection extending from drive portion 218 to lower cam portion 222 to permit the application of a positive upward load on lower cam portion 222 upon disengagement. Were it not for the advantage of this retrieval, connector rings 340, 342, 344, and 346 may not be required.

Connector rings 344, 346 adjacent drive portion 218 and cam portion 222, respectively, must have a minimum length to ensure the sealing engagement of annular links 334 and 338. If connector rings 344, 346 are too short, there will be insufficient bending to allow links 334 and 338 to contact surfaces 61, 140, respectively. Because drive portion 218 and cam portion 222 are massive in size when compared to connector rings 344, 346, the comparative massive body of portions 218, 222 will not bend so as to permit the sealing engagement of links 334, 338. Thus, it is essential that connector rings 344, 346 permit such bending. Connector rings 340, 342, 344, and 346 provide a local high stress contact point throughout metal Z portion 220.

The metal Z portion 220 is made of a very soft ductile steel such as 316 stainless. Such metal would have a yield of approximately 40,000 psi. This yield is less than half the yield of approximately 85,000 psi of the material for wellhead 24 and hanger 50. Upon sealing engagement of metal Z portion 220, metal Z portion 220 plastically deforms while surface 61 of wellhead 24 and surface 140 of hanger 50 tends to elastically deform. Should there be any imperfection in surfaces 61, 140, the ductility of the material of annular Z portion 220 will permit such material to deform or flow into the peaks and valleys of the imperfections of surfaces 61, 140 to achieve a high compression metal-to-metal seal. Thus, metal Z portion 220 is adapted for coining into sealing contact with walls 61, 140 of wellhead 24 and casing hanger 50 respectively, upon actuation.

Upper, intermediate, and lower annular links 334, 336, 338 respectively, each have a diamond-shaped cross-section. Since the cross-section of links 334, 336, 338 is substantially the same, a description of link 336 shall serve as a description of links 334, 338. Annular link 336 includes substantially parallel upper and lower annular sides 348, 350 respectively, with upper side 348 facing generally upward and lower side 350 facing generally downward, substantially parallel inner and outer annular sides 352, 354 respectively, with outer side 352 facing radially outward and inner side 354 facing radially inward, and parallel inner and outer annular sealing contact rims 356, 358 respectively. Annular links 334, 338 have comparable upper and lower sides, inner and outer sides and inner and outer sealing contact rims.

In the holddown position, the sealing contact rims of links 334, 336, 338 are deformed substantially parallel with the bore wall 61 of wellhead housing 46 and the outer wall 140 of casing hanger 50. Upper connector ring 344 extends from the lower end 364 of upper drive portion 218 to the upper side 335 of upper link 334 to form an annular channel 366. Metal connector ring 340 extends from the lower side 337 of upper link 334 to upper side 348 of intermediate link 336 to form annular channel 368 and metal connector ring 342 extends from lower side 350 of intermediate link 336 to the upper side 339 of lower link 338 to form annular channel 370. Lower connector ring 346 extends from the lower side 341 of lower link 338 to the upper end 372 of lower cam portion 222 to form annular channel 374. Annular channels 366, 368, 370 and 372 between adjacent ridges assist in achieving the bending of Z portion 220 at predetermined locations, namely at connector rings 340, 342, 344, and 346. Lower end 364 of drive portion 218 is substantially parallel with the upper side 335 of upper link 334 and upper end 372 of cam portion 222 is substantially parallel with the lower side 341 of lower link 338. In the running and holddown positions, the outer and inner sealing contact rims have the same diameter as the outer and inner diameters of upper drive portion 218 and lower cam portion 222 respectively.

Upper and lower elastomeric members 330, 332 are molded to conform to the shapes of annular grooves 376, 378 formed by links 334, 336, 338 and are bonded to links 334, 336, 338. Upper and lower elastomeric members 330, 332 have outer and inner annular vertical sealing surfaces 380, 382 respectively, adapted for sealingly engaging bore wall 61 and outer wall 140 in the sealing position. The upper and lower annular ridges formed by sealing surfaces 380, 382 are chamfered to permit deformation into sealing position of members 330, 332 upon compression. Elastomeric members 330, 332 are also chamfered to permit a predetermined deformation of members 330, 332 between links 334, 336, 338. Although the cross sections of elastomeric members 330, 332 are substantially the same, inner elastomeric member 332 may be chamfered or trimmed more than outer elastomeric member 330 to avoid any premature extrusion of members 330, 332 prior to links 334, 336, 338 establishing an anti-extrustion seal with bore wall 61 of wellhead 24 and outer sealing surface 140 of casing hanger 50.

It is preferred that sealing means 210 include at least three links. This number is preferred since it provides an anti-extrusion link for each side of elastomeric members 330, 332. Also, the three links 334, 336, 338 achieve a symmetry of design. However, sealing means 210 could include one or more links and might well include a series of links capturing a plurality of elastomeric members. Surfaces 364 and 372 of drive portion 218 and lower cam portion 222, respectively, would preferably have tapers tapering in the same direction as the adjacent links such as links 334 and 338 shown in the preferred design.

The diamond shaped cross section of links 334, 336, 338 permits the mid-portion of links 334, 336, 338 to be very rigid. By having a thick mid-portion, the reduced areas at the ends of links 334, 336, 338 will become the area which will yield or bend such as that area adjacent to connector rings 340, 342, 344, 346. It is not desirable that links 334, 336, 338 bend or yield at their mid-portion. However, the particular diamond-shaped cross section shown occurs only because of the ease of manufacture of that shape. Links 334, 336 and 338 could have a continous convex or ellipsoidal shape. This shape might be termed frustoconoidic. This provides a protuberant center portion. If the cross section of links 334, 336, 338 were of the same thickness, links 334, 336, 338 might tend to bend or bow at their mid-section. Although it is preferred to have a thickened center portion for links 334, 336, 338 to control the point of bending at the rims for a predetermined plastic deformation and to insure there is no distortion at the center of links 334, 336, 338, links 334, 336, 338 may be frustoconical metal rings with a cross section of even thickness rather than frustoconoidic rings.

Referring now to FIGS. 4 and 4A, FIG. 4A illustrates sealing means 210 in the sealing position. Sealing means 210 is compressed as holddown actuator means 212 reaches the limit of its travel against latch spring 144 and packing nut 182 continues its downward movement on threads 118 of casing hanger 50 as shown in FIGS. 2B and 2C.

Metal-to-metal sealing means 210 is series actuated from bottom to top. In other words, the lowest annular link 338 bends and deforms first upon compression of sealing means 210 and is the first link to initiate sealing contact with surface 61 and surface 140. This series actuation is preferred to limit the drag of upper annular links 334, 336 down surfaces 61, 140 upon actuation if the upper links 334, 336 were to make sealing engagement prior to lower link 338. It is preferred that there be a balanced force applied to upper annular link 334.

Elastomeric members 330, 332 provide the initial seal. Elastomeric seals 330, 332 engage surfaces 61, 140 prior to the rims of annular links 334, 336, 338 contacting surfaces 61, 140. No extrusion of elastomeric seals 330, 332 is to occur past the rims upon the initial compression set of a few thousand psi, i.e., 3,000 psi, of sealing means 210. Links 334, 336, 338 provide a backup for members 330 and 332, an anti-extrusion means for such members and are a retainer for such members. Therefore, it is desired that the rims of links 334, 336, 338 engage surfaces 61, 140 prior to the elastomeric members 330 and 332 extruding past the adjacent rims. It is undesirable for such extrusion past the rims to occur prior to the sealing contact of the rims since any elastomeric material between the rims and surfaces 60, 140 may be detrimental to the sealing engagement of links 334, 336, 338. Thus, as shown and described, the volume of elastomeric material in members 330 and 332 has been calculated and predetermined so that the rims contact surfaces 60, 141 prior to any extrusion of members 330, 332.

Links 334, 336, 338 are designed to be thin enough to deform into sealing engagement upon a compression set of a few thousand psi. Connector rings 340, 342, 346 form stress points or weak areas around annular Z portion 220 locating the bending of Z portion 220 at predetermined points to cause the inner and outer rims of Z portion 220 to properly sealingly engage bore wall 61 and outer wall 140. Upon actuation, the rims coin onto bore wall 61 and outer wall 140 to form a metal-to-metal seal between wellhead 24 and casing hanger 50 thereby sealing upper annulus 134 from lower annulus 130 of the well. Sealing means 210 is designed to ensure that there is no fluid channel or leak path between surfaces 61 and 140.

In the sealing position lower link 338 bends at connector ring 346 causing the outer side 343 of lower link 338 to move downwardly and engage upper end 372 of lower cam portion 222. The taper of surface 372 of lower cam portion 222 provides an initial starting deformation angle for lower annular link 338. Surface 372 also ensures that link 338 will not become horizontal so as to prevent the disengagement of link 338 upon the removal of sealing means 210. As the lower end 364 of drive portion 218 moves downwardly, upper link 334 bends at connector ring 344 causing the inner side 333 of upper link 334 to engage lower end 364 as lower end 364 compressors Z portion 220. Intermediate link 336 moves from its angled position to a more horizontal position. Elastomeric members 330, 332 are compressed between links 334, 336, 338 and sealingly engage bore wall 61 and outer wall 140. The inner rims of links 334, 336, 338 make annular sealing contacts with outer wall 140 of casing hanger 50 at 380, 382 and 384 and the outer rims of links 334, 336, 338 make annular sealing contact with bore wall 61 of wellhead 24 at 386, 388, and 390. The seal means 210 thus achieves a six point annular metal-to-metal sealing contact. The sealing contact of the inner and outer rims causes links 334, 336, 338 to become antiextrusion rings for elastomeric members 330, 332. Elastomeric members 330, 332 serve as backup seals to the metal seals.

As links 334, 336, 338 move from their angled position to a more horizontal position upon actuation, each end or each inner and outer rim of links 334, 336, 338 move into engagement with bore walls 61 and 140. It is not intended that links 334, 336, 338 become horizontal. It is essential that the inner and outer rims of links 334, 336, and 338 become biased between bore wall 61 of wellhead 24 and outer wall 140 of casing hanger 50. The inner and outer rims of each link react from the bearing load of the other. For example, as inner rim 356 of link 336 bears against casing hanger wall 140, this contact places a reaction load on outer rim 358 moving outer rim 358 toward wellhead bore wall 61. If each link did not have an opposing rim, the link would continue to move downwardly until its side engaged an adjacent link rather than move into sealing engagement with either wall 61 or 140. This bearing against the inner and outer rims necessitates the prevention of any buckling or bending in the mid-portion of the link. Hence, the diamond-shaped cross section requires that the mid-portion of the link be rigid so that it cannot buckle or relieve itself. Further, if links 334, 336, 338 were permitted to become horizontal, the tolerances between the inside diameter of wellhead 24 and the outside diameter of casing hanger 50 would become critical. Also, where links 334, 336, 338 are not horizontal but at an angle, it is easier to disengage Z portion 220 upon extraction of sealing means 210. Surface 364 of drive portion 218 and surface 372 of lower cam portion 222 are tapered to prevent links 334 and 338 respectively, from becoming horizontal.

It should be understood that elastomeric seals 330, 332 may not be required where the rims of links 334, 336, 338 sufficiently engage surfaces 61 of wellhead 24 and 140 of casing hanger 50 to permit hydraulic pressure to be applied in annulus 134. Thus, members 330 and 332 may be eliminated in certain applications where there would be a void between links 334, 336 and 338. Also, it should be understood that members 330 and 332 may be replaced by a spacer which would permit a predetermined amount of collapse or deformation of links 334, 336, 338. As disclosed in the present embodiment, elastomeric members 330 and 332 become such a spacer means. Also, the present invention is not limited to an elastomeric material. Members 330 and 332 may be made of other resilient materials such as Grafoil, an all-graphite packing material manufactured by DuPont. Grafoil, in particular, may be used where fire resistance is desired. "Grafoil" is described in the publications "Grafoil-Ribbon-Pack, Universal Flexible Graphite Packing for Pumps and Valves" by F. W. Russell (Precision Products) Ltd. of Great Runmow, Essex, England, and "Grafoil Brand Packing" by Crane Packing Company of Morton Grove, Ill. Such publications are incorporated herein by reference.

It should also be understood that should a metal-to-metal seal not be desired, that channels 368, 370 and 374 might be used to carry elastomeric material to surfaces 61 and 140 to provide a primary elastomeric seal rather than a primary metal-to-metal seal as described in the preferred embodiment. Should the elastomeric seals 330, 332 by the primary seals, annular links 334, 336, 338 become the primary backup for elastomeric seals 330, 332. These links would become energized backup rings for members 330, 332. In such a case, the backup seals would not drag down into position.

The present invention is designed for 15,000 psi working pressures and therefore it is the objective of the present invention to achieve a 20,000 psi compression set on seal means 210 whereby seal means 210 is pre-energized in excess of the anticipated working pressure.

In achieving a 20,000 psi compression set, sealing means 210 is actuated by a combination of torque and hydraulic pressure. Initially, an initial torque of approximately 10,000 ft.-lbs. is applied to drill pipe 236 at the surface 18. Tongs were used to rotate drill pipe 236 so as to transmit the torque to running tool 200 and then thrust to seal means 210. Particularly, drill pipe 236 rotates mandrel 230 which in turn rotates outer sleeve 250 by means of spline connection 320. Outer sleeve 250 drives packing nut 182 by means of the castellated connection of lugs 198, 308. Packing nut 182 bears against drive portion 28 by transmitting thrust through bearing means 205. Since holddown actuator means 212 has previously reached the limit of its downward travel against latch ring 144 in moving to the holddown position, seal means 210 and specifically, Z portion 220 are compressed between drive portion 218 and lower cam portion 222. This torque applies an axial force of approximately 150,000 lbs.

As Z portion 220 is compressed between drive portion 218 and lower cam portion 222, elastomeric members 330, 332 becomes compressed between links 334, 336, 338 as links 334, 336, 338 move into a more horizontal position. As such compression occurs, elastomeric members 330, 332 begin to completely fill the grooves formed between links 334, 336, 338 housing elastomeric members 330, 332. The amount of elastomeric material of elastomeric members 330, 332 is predetermined such that as links 334, 336, 338 move into a more horizontal position, links 334, 336, 338 achieve sufficient contact with bore wall 61 of wellhead 24 and outer bore wall 140 of casing hanger 50 to function as metal anti-extrusion means for preventing the extrusion of elastomeric seals 330, 332. Particularly, the inside annular contact areas 382, 384 prevent the extrusion of inside elastomeric member 332 and annular contact areas 386, 388 prevent the extrusion of outside elastomeric member 330. Thus, an initial anti-extrusion seal is achieved by links 334, 336, 338 before elastomeric members 330, 332 can extrude past their adjacent annular sealing contact areas. It is essential that elastomeric members 330, 332 have the right volume of elastomeric material and the proper configuration so that upon compression of sealing means 210, metal anti-extrusion contact is achieved before the extrusion of elastomeric members 330, 332 past contact areas 382, 384, 386, and 388.

The particular objective of the initial torque is to set elastomeric back-up seals 330, 332 and it is not to establish a metal-to-metal seal between surfaces 61, 140 of wellhead 24 and casing hanger 50 respectively. The initial torque is unable to completely actuate the metal-to-metal seal means 210 because of friction losses in the riser pipe, the blowout preventer stack, the drill pipe itself, and more particularly, because of various thread loads such as at threads 118. Such friction losses limit the compression load which may be applied to sealing means 210 by drill pipe 236.

To achieve the desired compression set of sealing means 210, hydraulic pressure is combined with the torque to set the metal-to-metal seals of sealing means 210. Referring now to FIGS. 2A and 2B, blowout preventer 40 is shown schematically and includes rams 34 with kill line 38 communicating with annulus 134 below blowout preventer rams 34. Convention locates kill line 38 below the lowermost ram. Should the choke line 36, for some reason, be the lowermost line in blowout preventer 40, hydraulic pressure would be applied through choke line 36.

In applying pressure through kill line 38 and into annulus 134, it is necessary to seal off annulus 134. Note in FIG. 2A that kill line 38 is shown in phase with rams 34, but in actuality is manufactured 90° out of phase. In doing so, pipe rams 34 are closed to seal around drill pipe 236, O-ring seals 264, 266 seal between mandrel 230 and sleeve 240, O-ring seals 292, 294 seal between sleeve 240 and the interior surface 272 of hanger 50 and as discussed above, sealing means 210 provide the initial seal across annulus 134. Thus, hydraulic pressure may be applied through kill line 38 and into annulus 134.

Because of the corkscrew effect caused by the application of torque to a drill string such as drill pipe 236, 10,000 ft-lbs of torque is generally considered to be the most torque that can be transmitted through a drill pipe string in an underwater situation. In the present invention, a 10,000 ft-lb torque on drill pipe 236 will establish a seal across annulus 134 which would withstand a few thousand psi of hydraulic pressure. This relatively low pressure seal would then permit the pressurization of annulus 134 to further compress sealing means 210 which in turn increases the sealing engagement in annulus 134 to withstand additional hydraulic pressure. Metal annular Z portion 220 with annular links 334, 336, 338, is designed so that annular rings 334, 336, 338 are thin enough to establish a metal-to-metal seal in cooperation with elastomeric seals 330, 332 to withstand a hydraulic pressure of a few thousand psi upon the application of a 10,000 ft-lb torque.

In applying pressure on seal means 210, the effective pressure areas are the diameter of running tool seal 264 less the diameter of drill pipe 236 and in addition thereto, the annular seal area of sealing means 210. Since the annular seal area is fixed for a particular sized wellhead and casing hanger, the principal variable in determining the pressure setting force is the difference in pressure area between the running tool seal 264 and drill pipe 236. Thus, the difference may be varied to permit a predetermined compression setting force on sealing means 210. The difference in diameter may vary, for example, from between 5 inches and 10 inches.

The particular function of the hydraulic pressure is to provide an axial force capable of inducing 20,000 psi into the sealing means 210 without exceeding the pressure design limits of the apparatus in the wellhead system. The function of the torque on nut 182 after hydraulic pressure is applied is to cause nut 182 to follow the travel of sealing means 210 as it moves down under force and prevent its relaxing when the hydraulic force is relieved. It is essential that a high torque, i.e. 10,000 ft-lbs, be maintained in drill pipe 236 so that packing nut 182 follows seal means 210 since otherwise nut 182 might prevent the downward movement of sealing means 210. This procedure is repeated by gradually and continuously increasing the hydraulic pressure until packing nut 182 has been rotated a sufficient number of rotations to insure that a 20,000 psi compression set has been achieved by sealing means 210.

Running tool 200 is a combination tool for applying torque to holddown and sealing assembly 180 and for assisting in the application of hydraulic pressure to holddown and sealing assembly 180. The rotation of drill pipe 236 for the transmission of torque via running tool 200 to holddown and sealing means 180 permits an initial sealing engagement of sealing means 210 in annulus 134 between wellhead 24 and hanger 50 whereby hydraulic pressure may then be applied to annulus 134 to further set sealing means 210. As hydraulic pressure is gradually and continuously increased in annulus 134 through kill line 38, sealing means 210 is further compressed into a greater sealing engagement against surface 61 of wellhead 24 and surface 140 of hanger 50. As this sealing engagement increases, sealing means 210 will seal against an even greater annulus pressure. Thus, pressure through kill line 38 may be gradually increased until sealing means 210 has a compression set of approximately 20,000 psi. The hydraulic pressure applied through kill line 38 and annulus 134 does not exceed the design limits of the system. All systems have a standard working pressure which an operator may not exceed. The system of the present invention is designed for 15,000 psi working pressures and thus the hydraulic pressure in annulus 134 to fully actuate sealing means 210 cannot exceed 15,000 psi although a 20,000 psi compression set is desired. The pressure invention achieves a 20,000 psi compression set of sealing means 210 without applying a hydraulic pressure exceeding 15,000 psi.

As hydraulic pressure is gradually increased in annulus 134 to achieve a 20,000 psi compression set on sealing means 210, packing nut 182, due to the continuous application of the 10,000 ft-lb torque on drill pipe 236 which is transmitted to skirt 250, follows sealing means 210 downwardly in annulus 134 on threads 204. Upon the release of the hydraulic pressure through kill line 38 and annulus 134, packing nut 182 prevents the release of the 20,000 psi compression set on sealing means 210 due to the engagement of threads 204 with casing hanger 50.

It is essential that elastomeric seals 330, 332 are energized into sealing engagement after the application of the initial torque by drill pipe 236. Unless elastomeric members 330, 332 are engaged, the application of hydraulic pressure through kill line 38 will be lost past sealing means 210 into low annulus 130. However, the seal of elastomeric members 330, 332 need only be sufficient to seal against an incremental amount of hydraulic pressure through kill line 38 such as 500 psi. After the initial seal is achieved, the application of increasing amounts of hydraulic pressure will further compress Z portion 220 and elastomeric members 330, 332 to increase the metal-to-metal and elastomeric sealing contact with walls 61, 140. Such increased sealing contact will permit the continued increase in hydraulic pressure through kill line 38 for the further actuation of sealing means 210.

The seal actuation means just described is a simplification of prior art actuator arrangements. Prior art actuators pressure down through drill pipe to actuate an internal porting piston system. A dart seals off the end of the drill pipe bore for the application of pressure through the piston system which in turn applies pressure to the seal. Although such a prior art actuator system could be adapted to the present invention, the arrangement of the present invention has substantial advantages over the prior art.

It may be necessary to increase the initial torque applied to drill string 236 after blowout preventer rams 34 have been closed. Although the rubber contact of rams 34 with drill pipe 236 does not create the friction loss as would a metal-to-metal contact, some additional friction loss will occur. Thus, additional torque, if possible, may be applied to drill string 236 above the initial torque to overcome such friction loss. However, drill pipe 236 will rotate with rams 34 in the closed position. The annulus between the riser and drill pipe 236 contains well fluids which will cause well fluids to be disposed between pipe rams 34 and drill pipe 236 upon closure of blowout preventer 40. Thus, it is believed that the 10,000 ft-lb torque will not be substantially reduced. If, due to the particular application, the friction between pipe rams 34 and drill pipe 236 must be reduced, a special pipe joint, not shown, may be series connected in drill pipe 236 whereby pipe rams 34 engage a stationary tubular member having a rotating member passing therethrough to transmit torque past rams 34. Such a special pipe joint would include rotating seals between the stationary member and rotating inner member to prevent the passage of fluid.

Figure 5A:
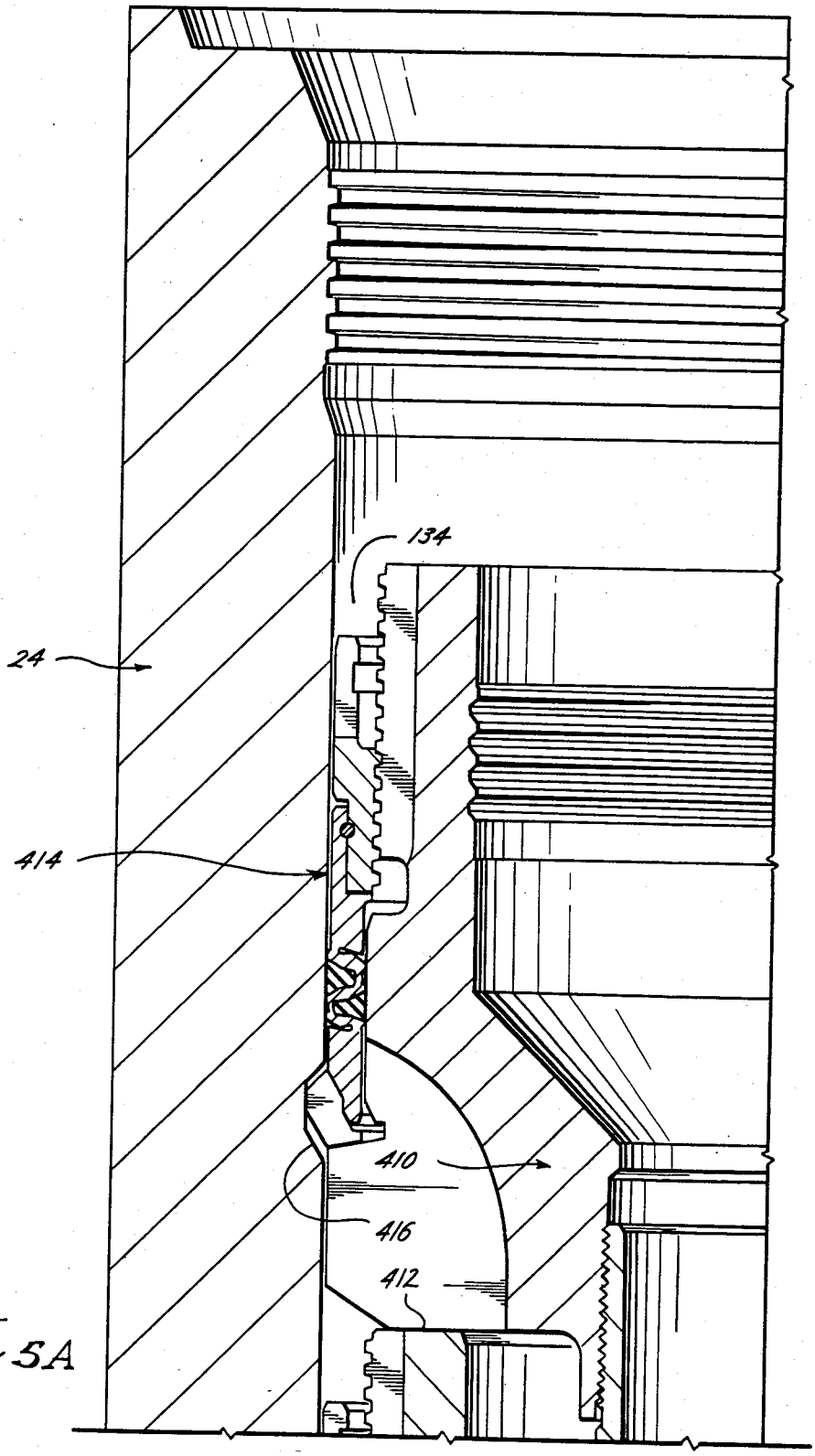
FIGS. 5A, 5B and 5C are section views of the wellhead with the casing hangers of the 16-inch, 13⅜ inch, 9⅝ inch and 7 inch casing strings landed and in the hold down position and in the sealing position.
Figure 5B:
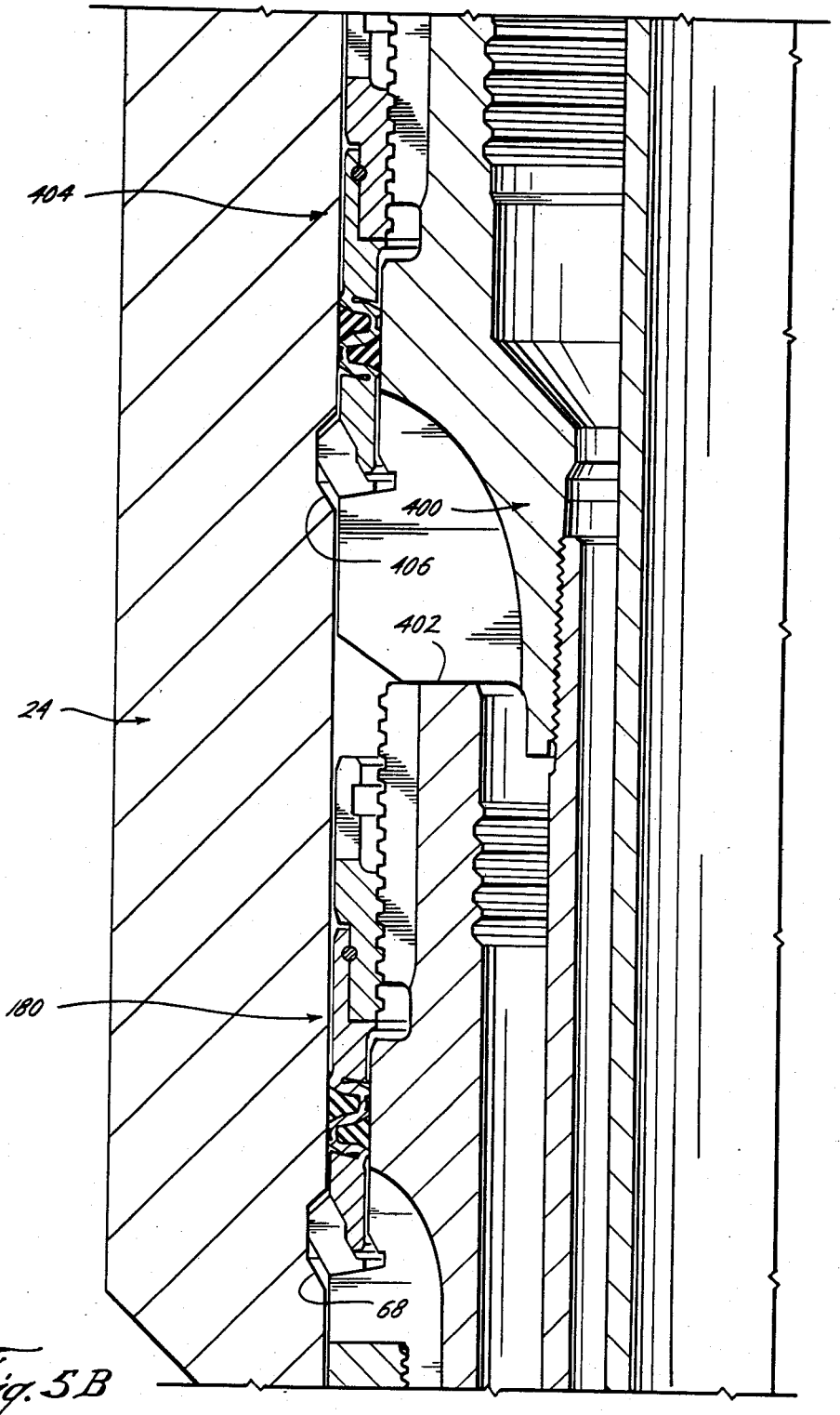
Figure 5C:
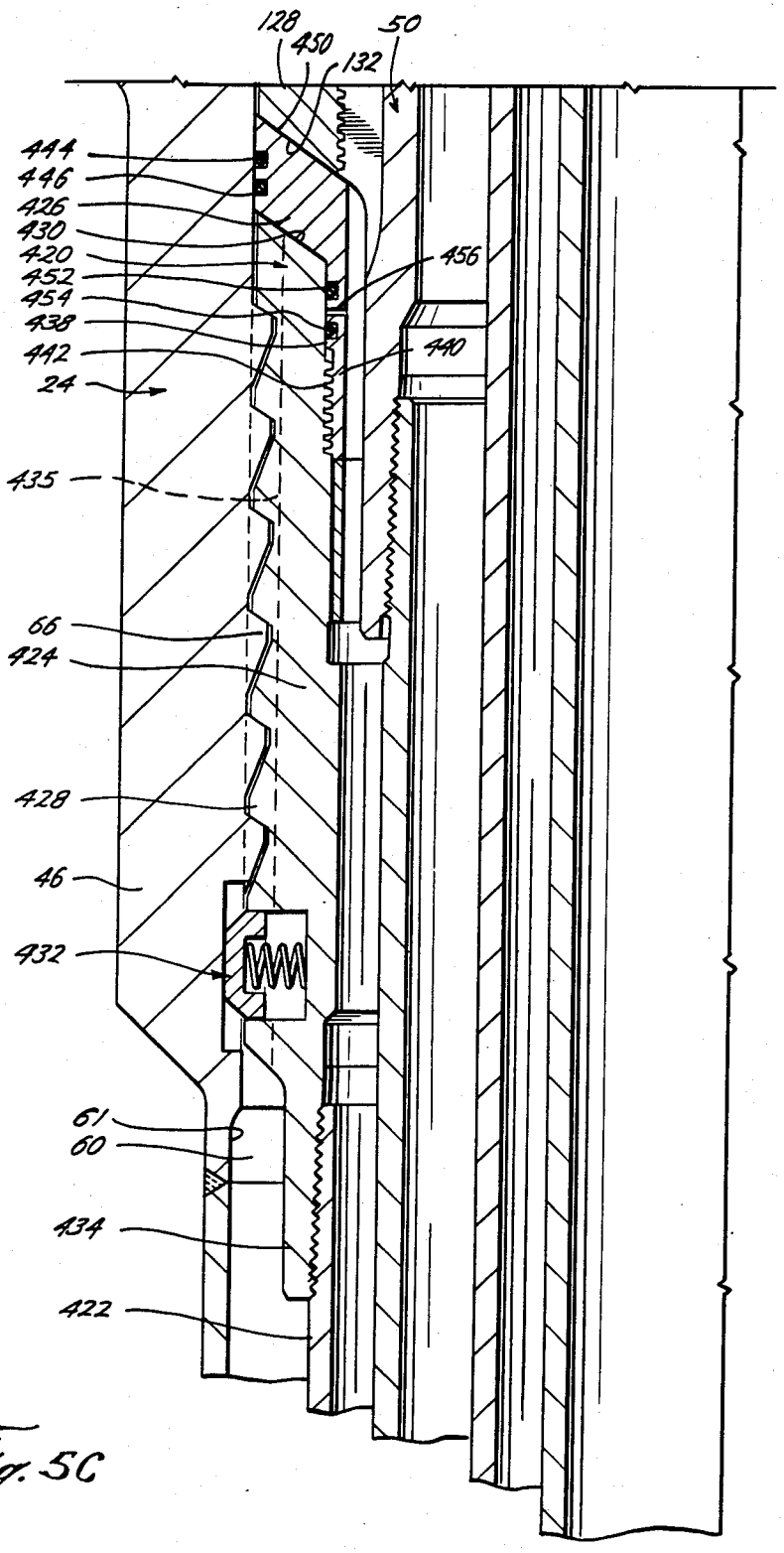

Referring now to FIGS. 5A, 5B, and 5C, there is shown the complete assembly of wellhead 24 with 16 inch casing hanger 420, 13⅜ inch casing hanger 50, 9⅝ inch casing hanger 400, and 7 inch casing hanger 410. Casing hanger 50 is shown in FIG. 5B in the holddown and sealing position described in FIGS. 1–4 with holddown and sealing assembly 180 actuated in the holddown and sealing position. 9⅝ inch casing hanger 400 is shown supported at 402 on top of casing hanger 50. Casing hanger 400 also includes a holddown and sealing assembly 404 comparable to assembly 180 of casing hanger 50. 7 inch casing hanger 410 is shown supported at 412 on top of 9⅝ inch casing hanger 400. Casing hanger 410 includes a holddown and sealing assembly 414 comparable to that of assembly 180. FIGS. 5A and 5B show the holddown grooves of wellhead 24, namely holddown groove 68 for casing hanger 50, holddown groove 406 for casing hanger 400, and holddown groove 416 for casing hanger 410.

Casing hangers 400 and 410 do not require a shoulder ring such as shoulder ring 128 for casing hanger 50. Since casing hangers 400, 410 support a smaller load, the amount of contact support area required for casing hanger 50 is not needed for casing hangers 400, 410. Hanger 50 requires a 100 percent contact area which is not required fo hangers 400, 410. Further, the shoulders on hangers 400, 410 are square and shoulder out evenly on top of the supporting hanger.

FIG. 5C discloses an alternative embodiment for removable casing hanger support seat means or breech block housing seat 70 shown in FIG. 2C. Referring now to FIG. 5C, a modified breech block housing seat 420 is shown adapted for lowering into bore 60 and connecting to breech block teeth 66 of wellhead 24.

In certain areas there are formations below the 20 inch casing which cannot take the pressure of the weight of the mud used to contain the bottom hole pressure. To prevent the rupture of this formation by the weight of the mud, it becomes necessary to run a 16 inch casing string down through that formation before drilling the bore for the 13⅜ inch casing. The modified breech block housing seat 420 suspends the 16 inch casing. Thus, breech block housing seat 420 doubles both as a support shoulder for casing hanger 50 and a casing hanger for the 16 inch casing 422.

Housing seat 420 includes a solid annular tubular ring 424 and a packoff ring 426. Solid annular tubular ring 424 includes exterior breech block teeth 428 substantially the same as breech block teeth 76 described with respect to housing seat 70. Ring 424 also has an upwardly facing and tapering conical seat or support shoulder 430 adapted for engagement with packoff ring 426. Ring 424 also includes a plurality of keys 432, substantially the same as keys 92 shown in FIG. 2C, for locking housing seat 420 within wellhead housing 46. Ring 424 is provided with a box end 434 for threaded engagement to the upper pipe section of 16 inch casing string 422.

The upper portion of ring 424 includes a counterbore 438 for receiving the pin end 440 of packing ring 426. Packing ring 426 includes external threads for threaded engagement with the internal threads in counterbore 438 of ring 424 for threaded connection at 442. Packing ring 425 includes an upwardly facing support shoulder 450 for engagement with the downwardly facing shoulder 132 of casing hanger 50. O-ring seals 444 and 446 are housed in annular O-ring grooves around the upper end of packing ring 426 for sealing engagement with bore wall 61 of wellhead 24. Packing ring 426 also includes O-rings 452, 454 housed in annular O-ring grooves above thread 442 on pin 440 for sealing engagement with the wall of counterbore 438 of ring 424. A test port 456 is provided between O-rings 452, 454 testing the packoff ring 426.

Since the 16 inch casing string 422 must be cemented, housing seat 420 has flutes or passageways 435 shown in dotted lines on FIG. 5C. Passageways 435 include the natural flow-by of the breech block slots, such as slots 86, 87 of housing seat 70 and wellhead 24 shown in FIG. 3, and a series of circumferentially spaced slots through continuous annular flange 85 aligned above breech block slots 86, 87. The slots of flange 85 are more narrow than breech block slots 86, 87 to prevent seat 420 from passing through wellhead 24. Packing ring 426 is provided, after the cementing, to packoff annulus 134. To test packing ring 426, the rams of the blowout preventer are closed and the running tool is sealed below the test port 456 and annulus 134 is pressurized. If there is a leak between wellhead housing 46 and packing ring 426 or the packing ring and counterbore 438, it will be impossible to pressure up annulus 134. Also there will be an increased volume of hydraulic flow into annulus 134 from kill line 38. it is not necessary that packing ring 426 establish a high pressure seal since at this stage of the completion of the well, most pressures will be in the range of less than 5,000 psi.

It should be understood that one varying embodiment would include making housing seat 70 and casing hanger 50 one piece whereby seat 70 and hanger 50 could be lowered and disposed in wellhead 24 on one trip into the well. Hanger 50, for example, could include breech block teeth for direct engagement with wellhead breech block teeth 66.

Another varying embodiment would include extending the longitudinal length of the tubular ring 424 of housing seat 420 whereby sealing means 210 and/or actuator holddown means 212 could be disposed directly on housing seat 420 and between seat 420 and wellhead 24 for sealing and/or holddown engagement with wellhead 24. In such a case, packing ring 426 would no longer be required.

Because many varying and different embodiments may be made within the scope of the inventor's concept taught herein and because many modifications may be made in the embodiments herein detailed in accordance with the descriptive requirements of the law, it should be understood that the details herein are to be interpreted as illustrative and not in a limiting sense. Thus, it should be understood that the invention is not restricted to the illustrated and described embodiment, but can be modified within the scope of the following claims.

We claim:

1. A method for completing an underwater well having a weak formation extending below the conductor casing, which formation cannot otherwise withstand the pressure of the drilling mud required to contain the downhole pressure of the well, comprising the steps of:

(a) locating drilling means at an underwater well site above the weak formation;

(b) installing conductor casing in the floor of a body of water with a wellhead, blowout preventer stack, and riser attached thereto at a point near the floor, the riser extending upwardly to the drilling means;

(c) running a drill string and standard drill bit through the wellhead and conductor casing;

(d) drilling a hole for suspending an intermediate-sized formation support casing within said wellhead and conductor casing;

(e) lowering a hanger-support member having the intermediate-sized formation support casing string attached thereto into the well until the hanger-support member lands in the wellhead, said intermediate-sized formation support casing string extending below the conductor casing and through the weak formation;

(f) rotating the hanger-support member less than 360° to connect the hanger-support member within the wellhead;

(g) latching the hanger-support member within the wellhead;

(h) drilling a hole for suspending the outermost surface casing within the wellhead and conductor casing and the intermediate-sized formation support casing;

(i) running a casing hanger with such outermost surface casing string attached thereto through the riser and into the wellhead; and (j) landing the casing hanger with such outermost surface casing string attached thereto on the hanger-support member.

2. Method according to claim 1, wherein the step (e) includes prior to the landing of the hanger-support member in the wellhead, passing a plurality of circumferentially spaced apart groupings of tooth segments on the outer periphery of the hanger-support member downwardly along spaces between a plurality of circumferentially spaced apart groupings of tooth segments on the inner periphery of the wellhead.

3. Method according to claim 2, wherein the step (f) includes engaging the tooth segments on the hanger-support member with the tooth segments on the wellhead.

4. Method according to claim 2, wherein the step (e) includes prior to passing the groupings of tooth segments on the hanger-support member downwardly along spaces between the groupings of tooth segments on the wellhead, engaging the tops of the uppermost tooth segments on the wellhead with the bottoms of the lowermost tooth segments on the hanger-support member, and rotating the hanger-support member less than one revolution to align the groupings of tooth segments on the hanger-support member with the spaces between the groupings of tooth segments on the wellhead.

5. Method according to claim 4, wherein the step (f) includes engaging the tooth segments on the hanger-support member with the tooth segments on the wellhead.

6. Method according to claim 1, wherein the step (f) includes engaging circumferentially spaced apart groupings of breech block teeth on the outer periphery of the hanger-support member with correlative circumferentially spaced apart groupings of breech block teeth in the wellhead bore.

7. Method according to claim 1, wherein the step (f) includes both holding down and supporting of said hanger-support member within said wellhead by said connection resulting from rotating said hanger-support member less than 360°.

8. Method according to claim 1, wherein there is included a step (gg) after step (g) and before step (h), including:

(gg) cementing the intermediate-sized formation support casing string in place below the conductor casing through passageways along the exterior surface of the hanger-support member.

9. Method according to claim 8, wherein there is included a step (ggg) after step (gg) and before step (h), including:

(ggg) installing a packoff ring on the hanger-support member for sealing between the packoff ring and the bore wall of the wellhead and between the packoff ring and the interior bore of the hanger-support member to seal off the upper annulus of the well.

10. A method for completing an underwater oil or gas well having a working pressure in the 15,000 psi range and extending through a weak subsurface formation below the conductor casing of the well, the borehole through which is otherwise unable to support, without rupturing, the pressure of the weight of the drilling mud used to contain the bottom hole pressure, comprising the steps of:

(a) locating drilling means at an underwater well site above the weak subsurface formation;

(b) installing and cementing a 20 inch conductor casing in the floor of a body of water with a wellhead, blowout preventer stack, and riser attached thereto at a point near the floor, the riser extending upwardly to the drilling means;

(c) running a drill string and standard 17½ inch drill bit through the wellhead and 20 inch conductor casing;

(d) drilling a hole for suspending a 16 inch casing within said wellhead and 20 inch conductor casing;

(e) lowering a hanger-support member having an upwardly facing support shoulder on its upper end and a 16 inch casing string attached to its lower end into the well until the hanger-support member lands in the wellhead, said 16 inch casing string extending below the 20 inch conductor casing and through the weak formation;

(f) rotating the hanger-support member less than 360° to connect the hanger-support member within the wellhead;

(g) latching the hanger-support member within the wellhead;

(h) cementing the 16 inch casing string in place below the 20 inch conductor casing through passageways along the exterior surface of the hanger-support member;

(i) installing a packoff ring having an upwardly facing support shoulder on its upper end on the support shoulder of the hanger-support member for sealing between the packoff ring and the bore wall of the wellhead and between the packoff ring and the interior bore of the hanger-support member to seal off the upper annulus of the well;

(j) drilling a hole for suspending another casing string within the wellhead;

(k) running a casing hanger with such other casing string attached thereto through the riser and into the wellhead; and (l) landing the casing hanger on the support shoulder of the packoff ring.

* * * * *

UNITED STATES PATENT AND TRADEMARK OFFICE

CERTIFICATE OF CORRECTION

PATENT NO. : 4,540,053

DATED : SEPTEMBER 10, 1985

INVENTOR(S) : BENTON F. BAUGH, HERMAN O. HENDERSON, JR., JOHN H. FOWLER, and ARTHUR AHLSTONE It is certified that error appears in the above—identified patent and that said Letters Patent is hereby corrected as shown below:

On the title page:

[75] Inventors: insert the name -- Arthur Ahlstone, Ventura, Calif.--.

Column 1, line 19, delete "wheelhead" and insert —wellhead—;

Column 1, line 46, delete "for restricted" and insert —restrict—;

Column 2, line 30, change "no" to --not--;

Column 3, line 31, change "if" to --of--;

Column 5, line 11, change "offshoe" to --offshore--;

Column 5, line 68, after the word "1/2" insert --inch--;

Column 10, line 45, change "to" to --for--;

Column 10, line 59, change "was" to --were--;

Column 11, line 4, change "Holddown assembly and sealing" to --Holddown and sealing assembly--;

Column 11, line 10, change "castelated" to --castellated--;

Column 11, line 45, after the word "FIG. 2" change "A" to —C—;

Column 11, line 64, change "pin" to —box—;

UNITED STATES PATENT AND TRADEMARK OFFICE

CERTIFICATE OF CORRECTION

PATENT NO. : 4,540,053

DATED : SEPTEMBER 10, 1985

INVENTOR(S) : BENTON F. BAUGH, HERMAN O. HENDERSON, JR., JOHN H. FOWLER, and ARTHUR AHLSTONE It is certified that error appears in the above—identified patent and that said Letters Patent is hereby corrected as shown below:

Column 12, line 3, after the word "upper" change "pin" to —box—;

Column 12, line 49, change "castilated" to —castellated—;

Column 12, line 50, change "castilated" to —castellated—;

Column 13, line 8, change "grooves" to —groove—;

Column 13, line 10, delete "until shoulder 269 engages projection 252";

Column 13, line 18, change "castelated" to —castellated—;

Column 13, line 51, change "castelated" to —castellated—;

Column 13, line 59, after "FIG. 2" insert —C—;

Column 14, line 40, after "334" delete "and" and insert —, —;

Column 15, line 27, after "and" delete "372" and insert —374—;

Column 16, line 28, change "spring" to —ring—;

Column 18, line 29, change "by" to —be—;

Column 18, line 44, change "were" to —are—;

UNITED STATES PATENT AND TRADEMARK OFFICE

CERTIFICATE OF CORRECTION

PATENT NO. : 4,540,053

DATED : SEPTEMBER 10, 1985

INVENTOR(S) : BENTON F. BAUGH, HERMAN O. HENDERSON, JR., JOHN H. FOWLER, and ARTHUR AHLSTONE It is certified that error appears in the above—identified patent and that said Letters Patent is hereby corrected as shown below:

Column 18, line 51, change "28" to --218--;

Column 20, line 11, change "the" to --this--;

Column 20, line 58, change "pressure" to --present--;

Column 22, line 10, change "fo" to --for--;

Column 22, line 48, after the word "ring" change "425" to --426--;

Column 23, line 1, delete "packoff" and insert -- pack off--;

Column 23, line 6, delete "the" and after the word "ring" insert the word --426--;

Column 24, line 43, delete the word "of".

Signed and Sealed this

*Fourth* Day of *March 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,540,053

DATED : September 10, 1985

INVENTOR(S) : Benton F. Baugh, et al.

It is certified that error appears in the above—identified patent and that said Letters Patent is hereby corrected as shown below:

In column 15, line 43, change "380, 382" to -- 381, 383 --.

In column 15, line 46, change "380, 382" to -- 381, 383 --.

In Figure 4, change "380" to -- 381 -- and change "382" to -- 383 --.

Signed and Sealed this

Fifteenth Day of March, 1988

*Attest:*

*Attesting Officer*

DONALD J. QUIGG

*Commissioner of Patents and Trademarks*